US007296874B2

(12) United States Patent
Horio et al.

(10) Patent No.: US 7,296,874 B2
(45) Date of Patent: Nov. 20, 2007

(54) INKJET RECORDING APPARATUS

(75) Inventors: Hideaki Horio, Fukuoka (JP); Hiroyuki Matsuba, Fukuoka (JP); Yoshinobu Ishimoto, Fukuoka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 287 days.

(21) Appl. No.: 10/927,151

(22) Filed: Aug. 27, 2004

(65) Prior Publication Data

US 2005/0046666 A1 Mar. 3, 2005

(30) Foreign Application Priority Data

Aug. 29, 2003 (JP) ..... 2003-306881

(51) Int. Cl.
*B41J 2/165* (2006.01)

(52) U.S. Cl. ..... 347/31; 347/29; 347/33

(58) Field of Classification Search ..... 347/42, 347/31, 33

See application file for complete search history.

(56) References Cited

U.S. PATENT DOCUMENTS 5,689,293 A * 11/1997 Hirano ..... 347/33
5,786,832 A * 7/1998 Yamanaka et al. ..... 347/45
5,798,775 A * 8/1998 Takahashi et al. ..... 347/33
6,074,037 A * 6/2000 Nakahara et al. ..... 347/29
6,203,136 B1 * 3/2001 Takahashi et al. ..... 347/32
6,217,146 B1 4/2001 Takahasi et al.
6,435,649 B2 8/2002 Takahasi et al.
6,474,566 B1 * 11/2002 Hirota et al. ..... 239/102.2
7,104,628 B2 * 9/2006 Yamazaki et al. ..... 347/29

FOREIGN PATENT DOCUMENTS

JP 4-247957 9/1992
JP 10-52910 2/1998
JP 2875636 1/1999

OTHER PUBLICATIONS

English Language Abstract of JP 4-247957.
English Language Abstract of JP 10-52910.
U.S. Appl. No. 10/927,150 to Matsuba et al.
U.S. Appl. No. 10/930,783 to Esaki et al.

* cited by examiner

*Primary Examiner*—Thinh Nguyen
(74) *Attorney, Agent, or Firm*—Greenblum & Bernstein, P.L.C.

(57) ABSTRACT

An inkjet recording apparatus includes an absorber configured to abut a nozzle surface of a line head to absorb ink adhered on the nozzle surface. A portion of the absorber which corresponds to an opening of a nozzle is removed. The absorber is configured to abut the nozzle surface except for a portion near the nozzle. Ink remaining on the nozzle surface is absorbed by the absorber. Thus, when the nozzle surface is wiped with a blade, accumulation of a large amount of remaining ink is prevented.

14 Claims, 26 Drawing Sheets

INKJET RECORDING APPARATUS

CROSS-REFERENCE TO RELATED APPLICATION

This application claims priority under 35 U.S.C. §119(a) on Japanese Patent Application No. 2003-306881 filed on Aug. 29, 2003, the entire contents of which are hereby incorporated by reference.

BACKGROUND OF THE INVENTION

1. Field of the Invention

The present invention relates to an inkjet recording apparatus.

2. Description of the Prior Art

A serial inkjet recording apparatus which incorporate a nozzle head having nozzles has conventionally been known wherein ink is ejected from the nozzles while the nozzle head is moved in the width direction of a recording medium, whereby recording on the recording medium is performed (see, for example, the publication of Japanese Patent No. 2875636). An inkjet recording apparatus which incorporates a line head having nozzles arranged to cover the entire width of a recording medium in view of higher recording rate has conventionally been known wherein recording is performed without moving the head. (For example, see Japanese Unexamined Patent Publication No. 10-52910.)

In the inkjet recording apparatuses, ink remaining on a nozzle surface is sometimes condensed because of evaporation of moisture to have high concentration and high viscosity. In other cases, dust, or the like, is adhered on the nozzle surface. Accordingly, the nozzle surface is contaminated during continuous recording by ink ejection. Thus, in the inkjet recording apparatuses, it is necessary to periodically clean the nozzle surface. For example, a recording apparatus disclosed in the publication of Japanese Patent No. 2875636 has a blade for wiping the nozzle surface and an absorber attached to the nozzle surface for absorbing ink adhered on the blade.

The ink (including the dust, or the like) remaining on the nozzle surface can be collected by wiping the nozzle surface with the blade. However, the remaining ink is sometimes squeezed into nozzles by the wiping operation. Especially, the recording apparatus disclosed in Japanese Unexamined Patent Publication No.10-52910 has an elongated line head, and therefore, a large amount of remaining ink is collected by wiping the nozzle surface with the blade in the longitudinal direction. Accordingly, the possibility that the remaining ink is squeezed into the nozzles increases.

SUMMARY OF THE INVENTION

The present invention was conceived in view of the above problems. An objective of the present invention is to surely clean a nozzle surface of an inkjet recording apparatus.

An inkjet recording apparatus of the present invention is an apparatus for ejecting ink through nozzles onto a recording medium.

The recording apparatus comprises: a nozzle head including a nozzle surface in which two or more nozzles are provided; and an absorber which abuts the nozzle surface to absorb ink adhered on the nozzle surface.

A portion of the absorber which corresponds to openings of the nozzles is removed such that the absorber abuts the nozzle surface except for a region near the nozzles.

With this structure including the absorber, ink adhered on the nozzle surface of the nozzle head is absorbed by the absorber. Thus, the blade does not collect a large amount of remaining ink when it wipes the nozzle surface. Therefore, squeeze of the remaining ink into the nozzles is suppressed.

A portion of the absorber which corresponds to the openings of the nozzles is removed, such that the absorber abuts the nozzle surface except for a region near the nozzles. If the absorber should abut an opening of a nozzle, the absorber would absorb ink inside the nozzle head. However, according to the present invention, the absorber does not abut an opening of a nozzle, and therefore, such absorption of ink inside the nozzle head is prevented.

Another inkjet recording apparatus of the present invention comprises: a nozzle head including a nozzle surface in which two or more nozzles are provided; a blade for wiping the nozzle surface; and an absorber which abuts the nozzle surface to absorb ink adhered on the nozzle surface.

The absorber abuts the nozzle surface to absorb the ink before a wiping operation of the blade.

With this structure, ink adhered on the nozzle surface of the nozzle head is absorbed by the absorber before the blade wipes the nozzle surface. Thus, the blade does not collect a large amount of remaining ink when it wipes the nozzle surface. Therefore, squeeze of the remaining ink into the nozzles is suppressed.

Still another inkjet recording apparatus of the present invention comprises: a line head including two or more nozzle heads arranged along the width direction of the recording medium, each of the nozzle heads having a nozzle surface in which two or more nozzles are provided; a blade for wiping the nozzle surface; and an absorber which surrounds the nozzle heads of the line head.

In a line head including a plurality of nozzle heads arranged side by side, ink remains in a gap between adjacent nozzle heads. The ink is sometimes condensed to have high concentration and high viscosity and sticks to the blade again. In this case, if the blade onto which the remaining ink has stuck is used in a wiping operation, the nozzle surface can be contaminated the remaining ink, or the remaining ink can be squeezed into the nozzles.

In the inkjet recording apparatus having the above structure of the present invention, the remaining ink is absorbed by the absorber which surrounds each nozzle head. With this feature, contamination of the nozzle surface and squeeze of the remaining ink into the nozzles are prevented.

Other objectives of the present invention are apparent to those skilled in the art field within which the present invention falls from the detailed descriptions provided below in conjunction with the drawings attached hereto.

DESCRIPTION OF THE PREFERRED EMBODIMENTS

Hereinafter, an embodiment of the present invention is described in detail with reference to the drawings.

(General Structure of Recording Apparatus)

An inkjet head recording apparatus of this embodiment ejects ink droplets from an inkjet head onto a recording medium by utilizing the piezoelectric effect of a piezoelectric actuator, thereby performing recording on the recording medium.

Figure 1:
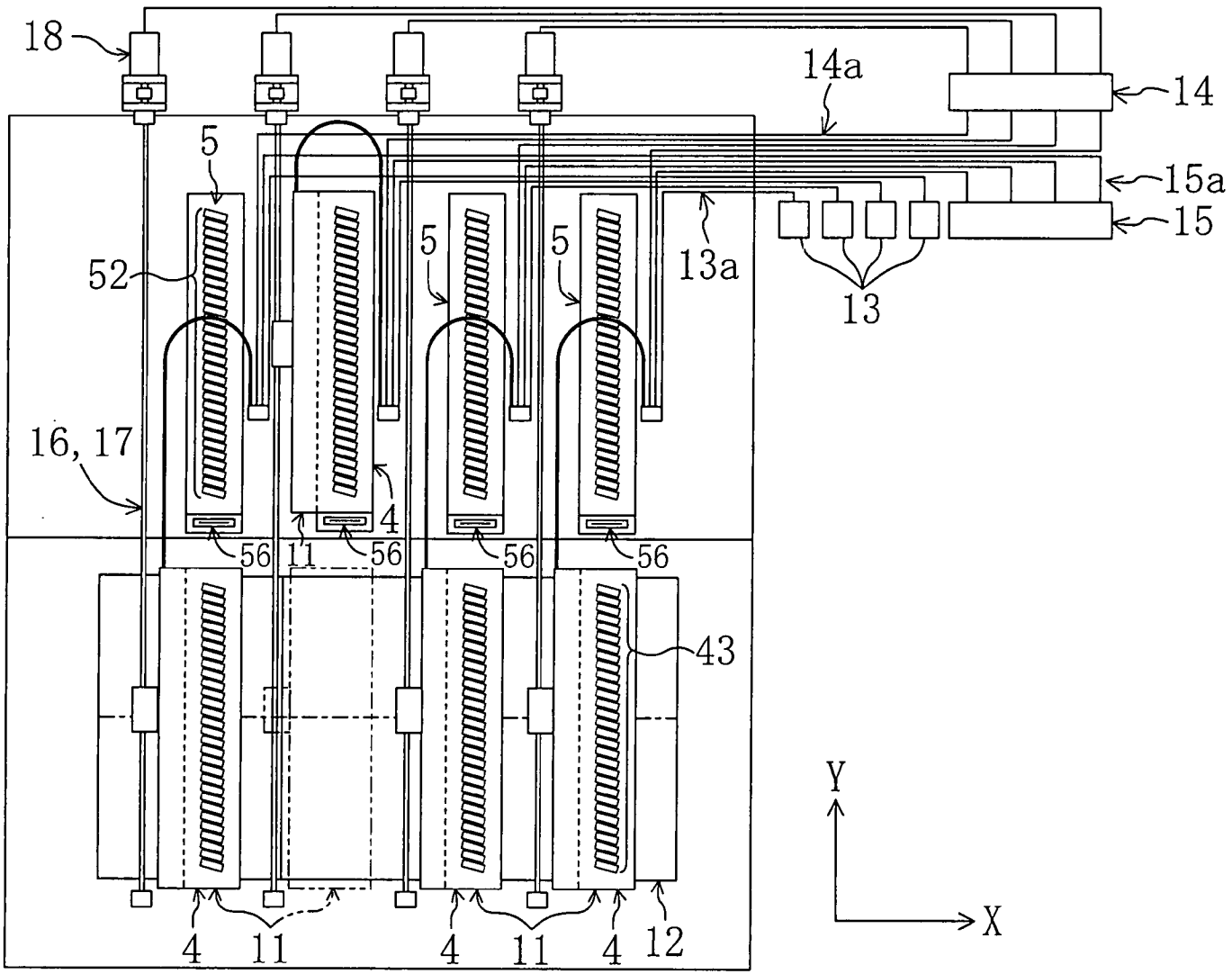
FIG. 1 is a plan view of a recording apparatus.
Figure 2:
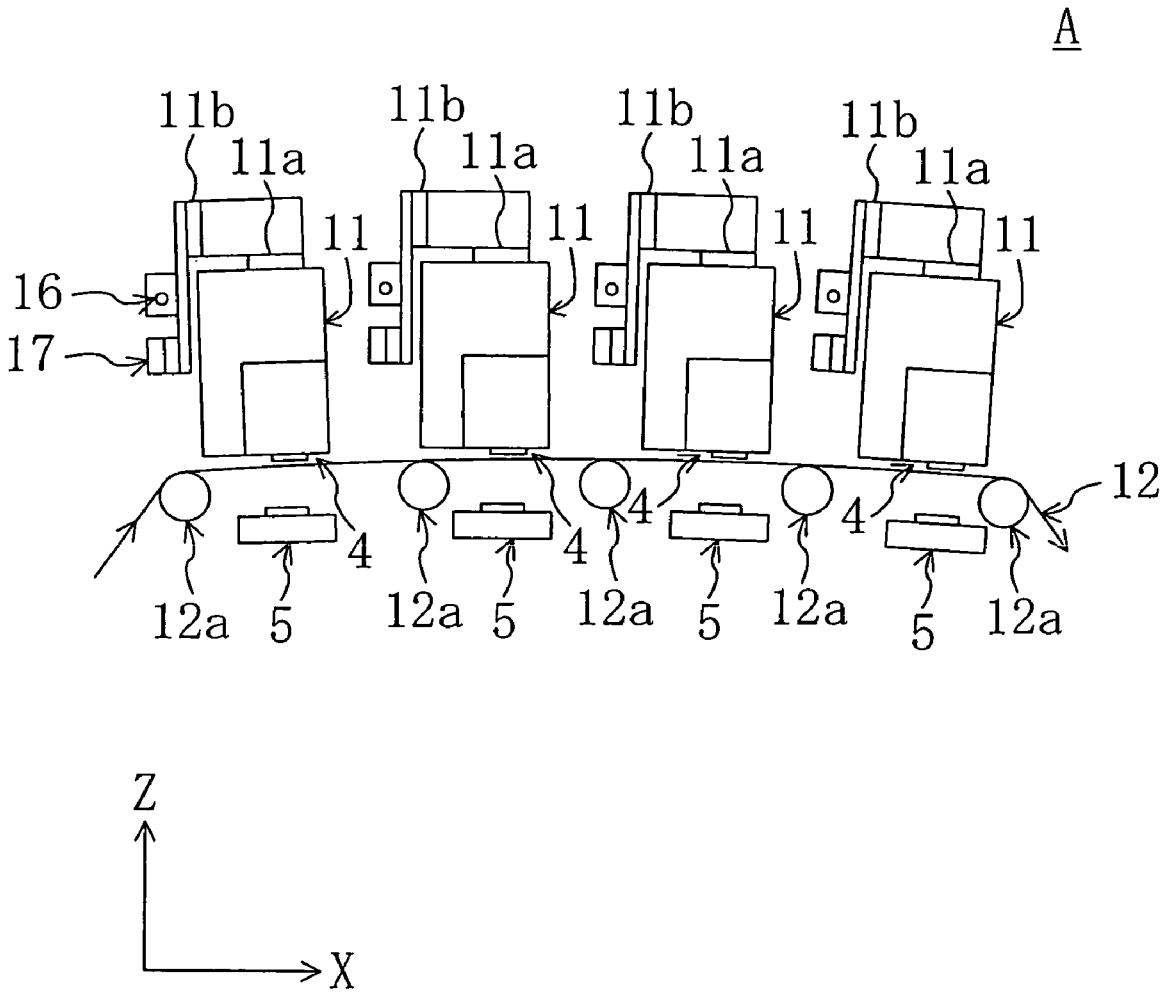
FIG. 2 is a front view of a recording apparatus.

The recording apparatus A has four inkjet heads 11 as shown in FIGS. 1 and 2. The four inkjet heads 11 include the inkjet head 11 for ejecting black ink, the inkjet head 11 for ejecting yellow ink, the inkjet head 11 for ejecting magenta ink and the inkjet head 11 for ejecting cyan ink. The recording apparatus A is capable of color printing with four colors of ink.

A recording medium 12 is transferred under the inkjet heads 11 in a predetermined transfer direction (X direction) by a plurality of rollers 12*a*. The recording medium 12 may be provided in the form of a roll of paper (not shown) such that paper (recording medium 12) is fed from the roll.

Each inkjet head 11 extends in the width direction (Y direction) of the recording medium 12. The four inkjet heads 11 are arranged along X direction in parallel to each other with predetermined intervals.

Figure 5:
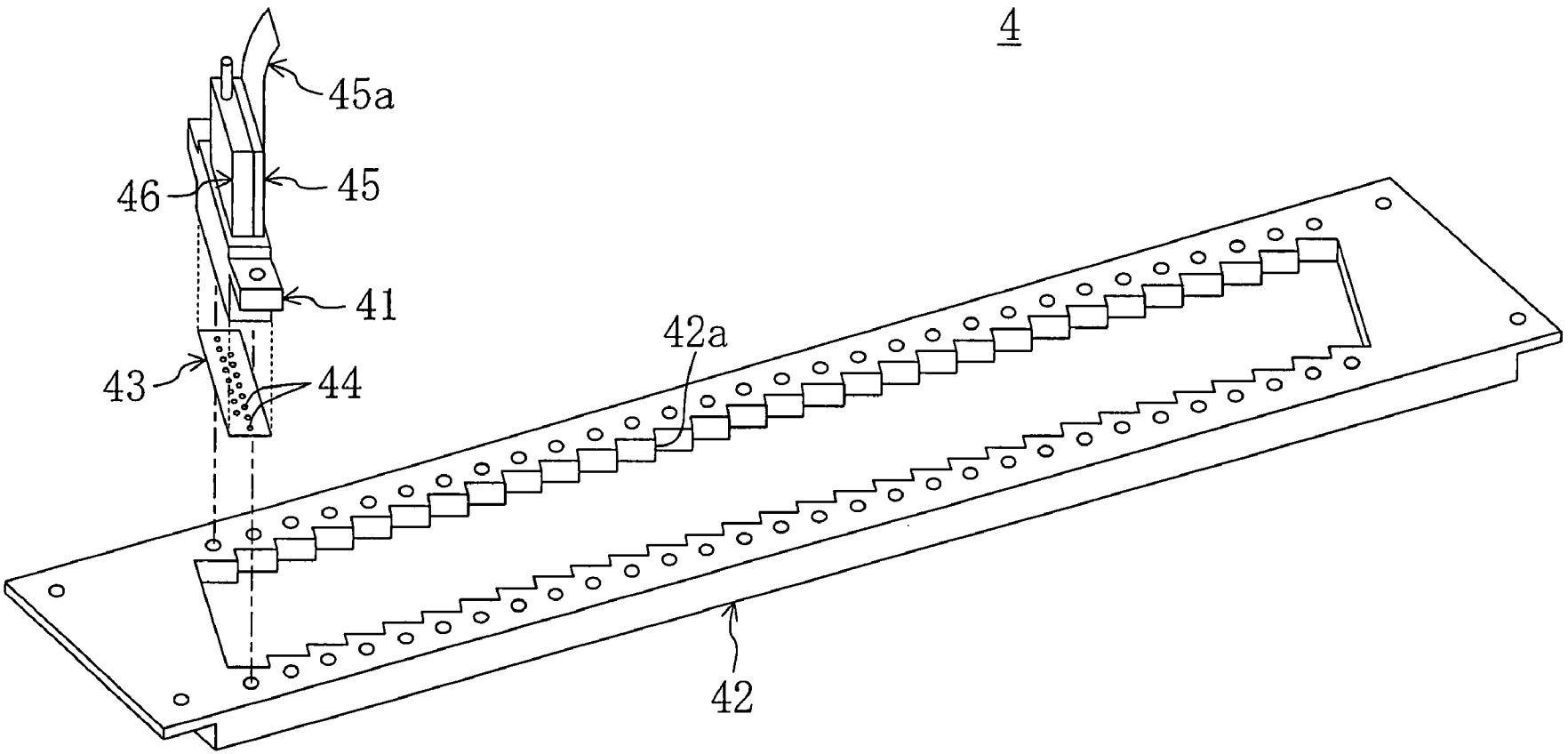
FIG. 5 is an exploded perspective view of a line head.

Each inkjet head 11 has a line head 4 which extends in Y direction as shown in FIGS. 1 and 5. The line head 4 has a plurality of nozzles 44 for ejecting ink and a plurality of piezoelectric actuators (not shown in FIGS. 1 and 5) for expelling the ink from the nozzles 44. The nozzles 44 are distributed over the entire width of the recording medium 12.

As described above, each inkjet head 11 has the nozzles 44 distributed over the entire width of the recording medium 12. Thus, in a recording operation, ink is ejected from predetermined nozzles 44 at predetermined timings while the recording medium 12 is transferred in the transfer direction. That is, a desired image can be formed on the recording medium 12 over the entire width thereof (e.g., JIS: A2 width) without moving the inkjet heads 11 along the width direction of the recording medium 12.

The recording apparatus A includes four purge units 5 for cleaning the line heads 4 of the inkjet heads 11. These purge units 5 are placed at external positions which deviate in Y direction from the transfer position of the recording medium 12. The plurality of purge units 5 are installed along X direction in parallel to each other with predetermined intervals so as to correspond to the inkjet heads 11. Details of the structure of the purge units 5 will be described later.

Each inkjet head 11 is supported by a ball screw 16 and a linear guide 17 which extend in Y direction. The ball screw 16 is rotated by a motor 18 which is attached to an end of the ball screw 16. The motor 18 rotates the ball screw 16, whereby the inkjet head 11 reciprocates along Y direction while being guided by the ball screw 16 and the linear guide 17. In this way, each inkjet head 11 moves between a recording position which is the transfer position of the recording medium 12 and a cleaning position which is the position where the purge unit 5 is provided. The four ball screws 16 are rotated by separate motors 18. Thus, each of the four inkjet heads 11 is capable of independently moving between the recording position and the cleaning position.

Each inkjet head 11 is supported by the linear guide 17 and the ball screw 16 through a first rotation stage 11*a* which rotates around Z axis (extending in the vertical direction) and a second rotation stage 11*b* which rotates around X axis. The first rotation stage 11*a* adjusts the inclination of the line head 4 with respect to the width direction of the recording medium 12. The second rotation stage 11*b* adjusts the inclination of a line head bottom surface (nozzle surface) with respect to the recording surface of the recording medium 12. Since each line head 4 has an elongated shape, the distance between the nozzle surface and the recording medium changes due to the inclination of the line head 4 with respect to the surface of the recording medium 12. As a result, ink falls on a displaced position. Further, since a plurality of line heads 4 which eject different colors of inks are provided in parallel to each other along the transfer direction of the recording medium 12, a positional displacement is caused between the heads with respect to the recording medium 12, and as a result, color misalignment is caused. In view of such, the inclination of each line head 4 with respect to the recording medium 12 is adjusted by the first and second rotation stages 11*a* and 11*b*. With such a feature, an ink droplet falls onto a desired position over the recording medium 12, while displacement of the positions of ink droplets among a plurality of inkjet heads 11 is prevented. As a result, the image quality is improved.

The recording apparatus A has four ink tanks 13. The four ink tanks 13 include the ink tank 13 for containing black ink, the ink tank 13 for containing yellow ink, the ink tank 13 for containing magenta ink and the ink tank 13 for containing cyan ink. The four inkjet heads 11 and the four ink tanks 13 are connected on a one-to-one basis through ink tubes 13*a*. Ink contained in the ink tanks 13 are supplied to the inkjet heads 11 through the ink tubes 13*a*.

The recording apparatus A has a power control box 14. The inkjet heads 11 and the power control box 14 are connected through transmission lines 14*a*. The power control box 14 supplies electric power and a control signal to each inkjet head 11. The power control box 14 also supplies a control signal to each motor 18 attached to an end of the ball screw 16.

The recording apparatus A has an air supply 15. The inkjet heads 11 and the air supply 15 are connected through air tubes 15*a*. The air supply 15 supplies dry air to the inkjet heads 11. Supply of the dry air increases the lifespan of a piezoelectric actuator, i.e., the period that a piezoelectric actuator (piezoelectric element) normally operates, as will be described later.

The ink tubes 13*a*, the transmission lines 14*a* and the air tubes 15*a* are fixed by a fixing element at an intermediate position and tied in a bundle before being connected to the inkjet heads 11. With such a structure, interference between the reciprocating inkjet heads 11 and the tubes and transmission lines is avoided.

(Structure of Inkjet Head)

Figure 3:
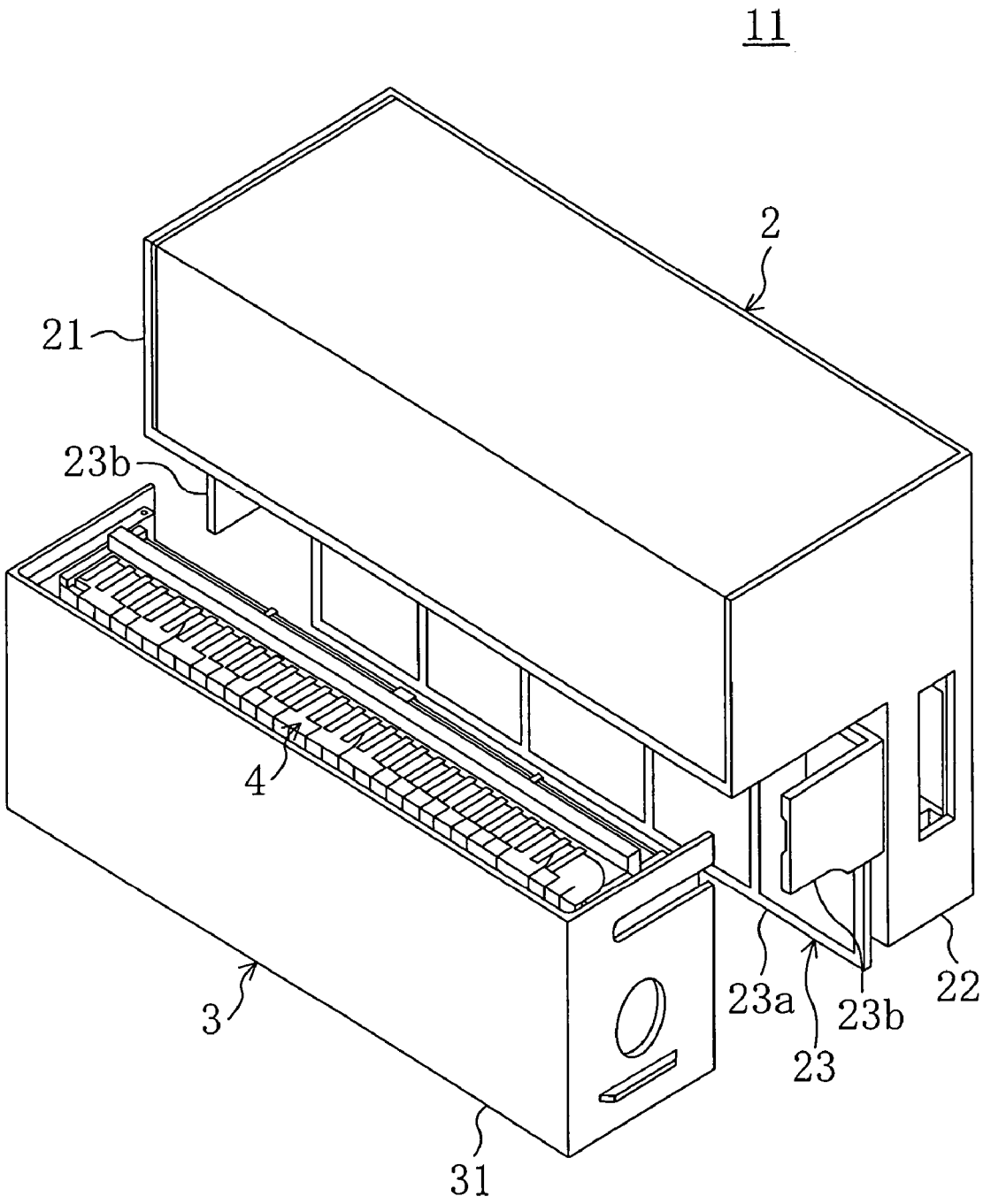
FIG. 3 is a perspective view of an inkjet head.

Each inkjet head 11 includes a main box 2 and a head box 3 as shown in FIG. 3.

The main box 2 includes a circuit section 21 at the upper side and an ink section 22 at the lower side. The circuit section 21 incorporates a circuit board. The ink section 22 incorporates ink tubes, etc. The main box 2 has a rectangular parallelepiped shape, a part of which is cut away.

The head box 3 includes a line head 4 and a cover 31 for covering the line head 4. The head box 3 has a generally rectangular parallelepiped shape. The head box 3 is fitted into the cut-away space of the main box 2, such that the entire inkjet head 11 has a generally rectangular parallelepiped shape.

Figure 4:
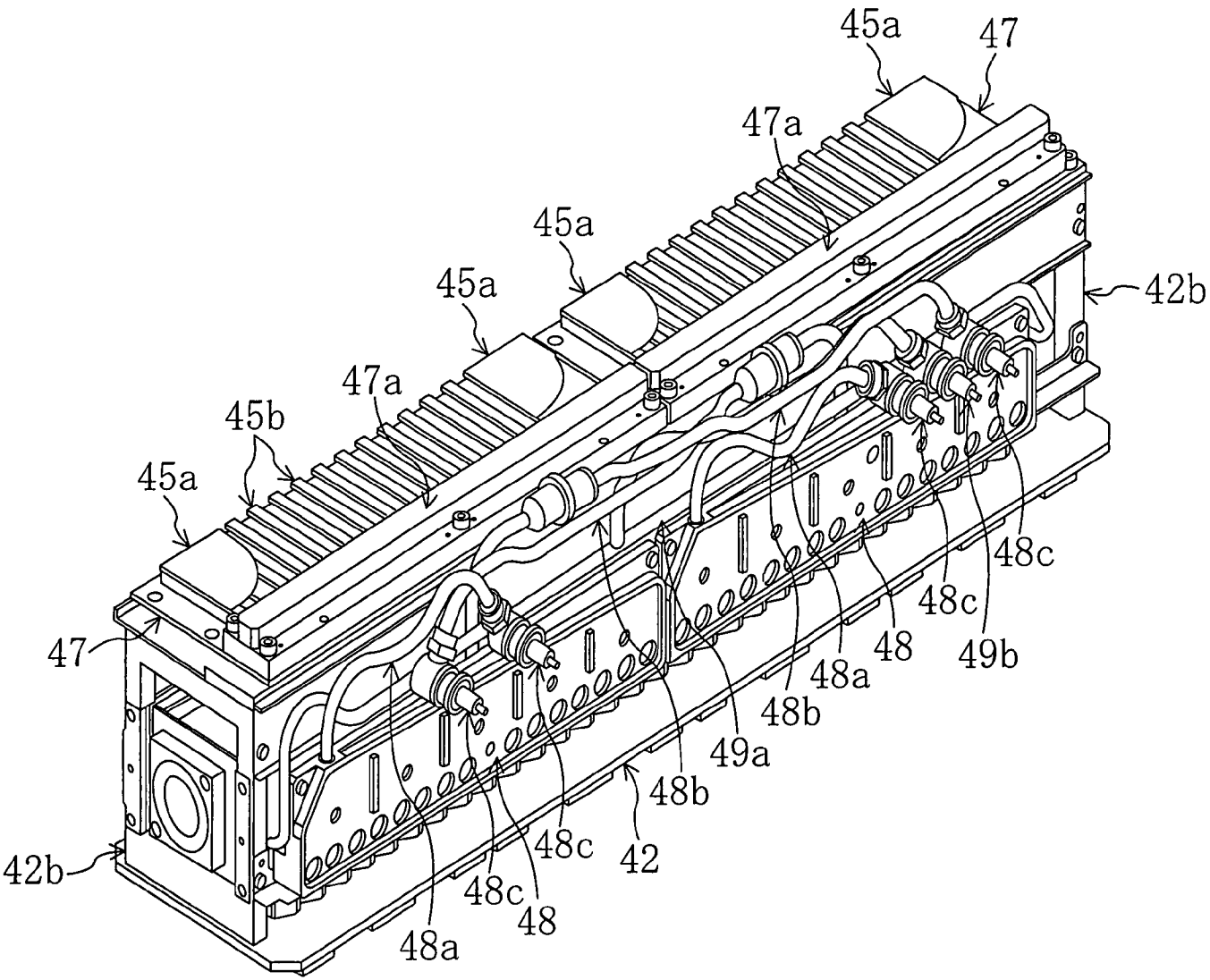
FIG. 4 is a perspective view of a line head.
Figure 6:
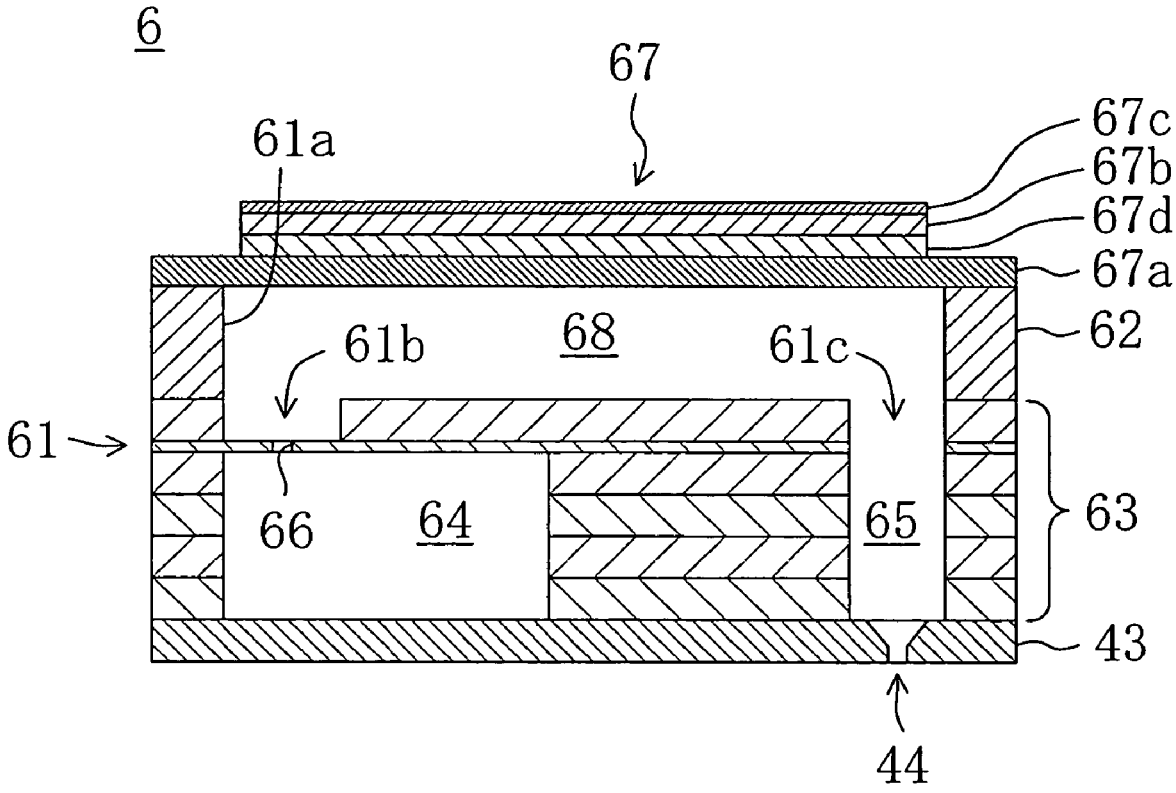
FIG. 6 shows a longitudinal cross section of a nozzle head.

The line head 4 includes, as shown in FIGS. 4 and 5, a plurality of head bases 41 and a base plate 42 for holding the head bases 41. Each head base 41 incorporates a nozzle head 6 (see FIG. 6). The head base 41 is provided with a driver board 45 and a sub tank 46 attached thereto. The driver board 45 supplies a driving waveform to the nozzle head 6. The sub tank 46 contains ink.

The base plate 42 is made of an elongated plate material and has an opening 42*a* in the center thereof. The opening 42*a* is elongated in the longitudinal direction of the base plate 42 and has corrugated edges. The head bases 41 are fixed to the base plate 42 with an inclination from the longitudinal direction of the base plate 42 so as to fit with the corrugated edges. It should be noted that a plurality of head bases 41 (30 head bases 41 in the example of FIG. 5) are provided in the base plate 42 along the longitudinal direction of the base plate 42 although only one head base 41 is shown in FIG. 5.

Each head base 41 has a nozzle plate 43 in which a plurality of nozzles 44 are arranged generally in a staggered pattern. Since a plurality of head bases 41 are arranged along the longitudinal direction of the base plate 42 in parallel to each other, the nozzles 44 are arranged with generally-equal intervals over the entire width of the recording medium 12 along the width direction of the recording medium 12 (see FIG. 28; Note that in FIG. 28 some of the nozzles 44 are not shown. In an actual case, one nozzle plate 43 has, for example, 400 nozzles 44).

The nozzle head 6 incorporated in the head base 41 ejects ink due to the piezoelectric effect of the piezoelectric actuator as described above. The nozzle head 6 has a structure shown in FIG. 6.

The nozzle head 6 has a head main body 61 in which a plurality of concaved portions 61*a* for pressure rooms are formed. The concaved portions 61*a* correspond to the nozzles 44 formed in the nozzle plate 43 and are arranged in parallel to each other along a row of the nozzles 44. Each concaved portion 61*a* has a supply hole 61*b* for supplying ink to the concaved portion 61*a* and an ejection hole 61*c* for ejecting the ink from the concaved portion 61*a*.

A side wall of each concaved portion 61*a* is formed by a pressure room member 62. An ink passage member 63 is adhesively fixed onto the lower surface of the pressure room member 62. A bottom wall of the concaved portion 61*a* is formed by the ink passage member 63.

The ink passage member 63 is a laminate of a plurality of thin plates. The ink passage member 63 has one ink supply passage 64, a plurality of ink ejection passages 65, and a plurality of orifices 66. Each of the orifices 66 is connected to the supply hole 61*b* of a corresponding one of the concaved portions 61*a*. The ink supply passage 64 extends along the direction in which the concaved portions 61*a* are arranged (the direction of a row of the nozzles 44) and is connected to the orifices 66. The ink supply passage 64 is connected to the sub tank 46, from which ink is supplied to the ink supply passage 64. Each of the ink ejection passages 65 is connected to the ejection hole 61*c* of a corresponding one of the concaved portions 61*a*.

The nozzle plate 43 is adhesively fixed onto the lower surface of the ink passage member 63. The nozzles 44 formed in the nozzle plate 43 are connected to the ink ejection passages 65.

The piezoelectric actuators 67 are provided above the concaved portions 61*a* of the head main body 61. Each of the piezoelectric actuators 67 has a diaphragm 67*a* made of Cr. The diaphragm 67*a* is adhesively fixed onto the upper surface of the head main body 61 so as to cover the concaved portions 61*a* of the head main body 61, such that the diaphragm 67*a* and the concaved portions 61*a* form pressure rooms 68. The diaphragm 67*a* is made of a single member which is commonly used for all of the actuators 67. The diaphragm 67*a* also functions as a common electrode which is commonly used among all of piezoelectric elements 67*b* (described later).

Each piezoelectric actuator 67 has a piezoelectric element 67*b* made of lead zirconate titanate (PZT) and an individual electrode 67*c* made of Pt. On a surface of the diaphragm 67*a* which is opposite to the pressure room 68 (i.e., the upper surface of the diaphragm 67*a*), an intermediate layer 67*d* made of Cu is provided at a portion of the surface which corresponds to the pressure room 68 (a portion above the opening of the concaved portion 61*a*), and the piezoelectric element 67*b* is provided on the intermediate layer 67*d*. The individual electrode 67*c* is bonded onto a surface of the piezoelectric element 67*b* which is opposite to the diaphragm 67*a* (i.e., the upper surface of the piezoelectric element 67*b*). Each individual electrode 67*c* functions together with the diaphragm 67*a* to apply a voltage (driving voltage) to a corresponding one of the piezoelectric elements 67*b*. It should be noted that all of the diaphragm 67*a*, the piezoelectric elements 67*b*, the individual electrodes 67*c* and the intermediate layers 67*d* are formed of thin films.

Each piezoelectric actuator 67 applies a driving voltage to the piezoelectric element 67*b* through the diaphragm 67*a* and the individual electrode 67*c*, thereby deforming a portion of the diaphragm 67*a* which corresponds to the pressure room 68 (a portion of the diaphragm 67*a* at the opening of the concaved portion 61*a*). As a result of the deformation of the diaphragm 67*a*, the ink in the pressure room 68 is ejected from the nozzle 44 through the ejection hole 61*c*.

Since the piezoelectric actuators 67 correspond to the nozzles 44, one head base 41 incorporates a plurality of piezoelectric actuators 67. The driver board (driver circuit) 45 is a circuit for selectively supplying a driving voltage to the piezoelectric actuators 67 as will be described later.

Figure 7:
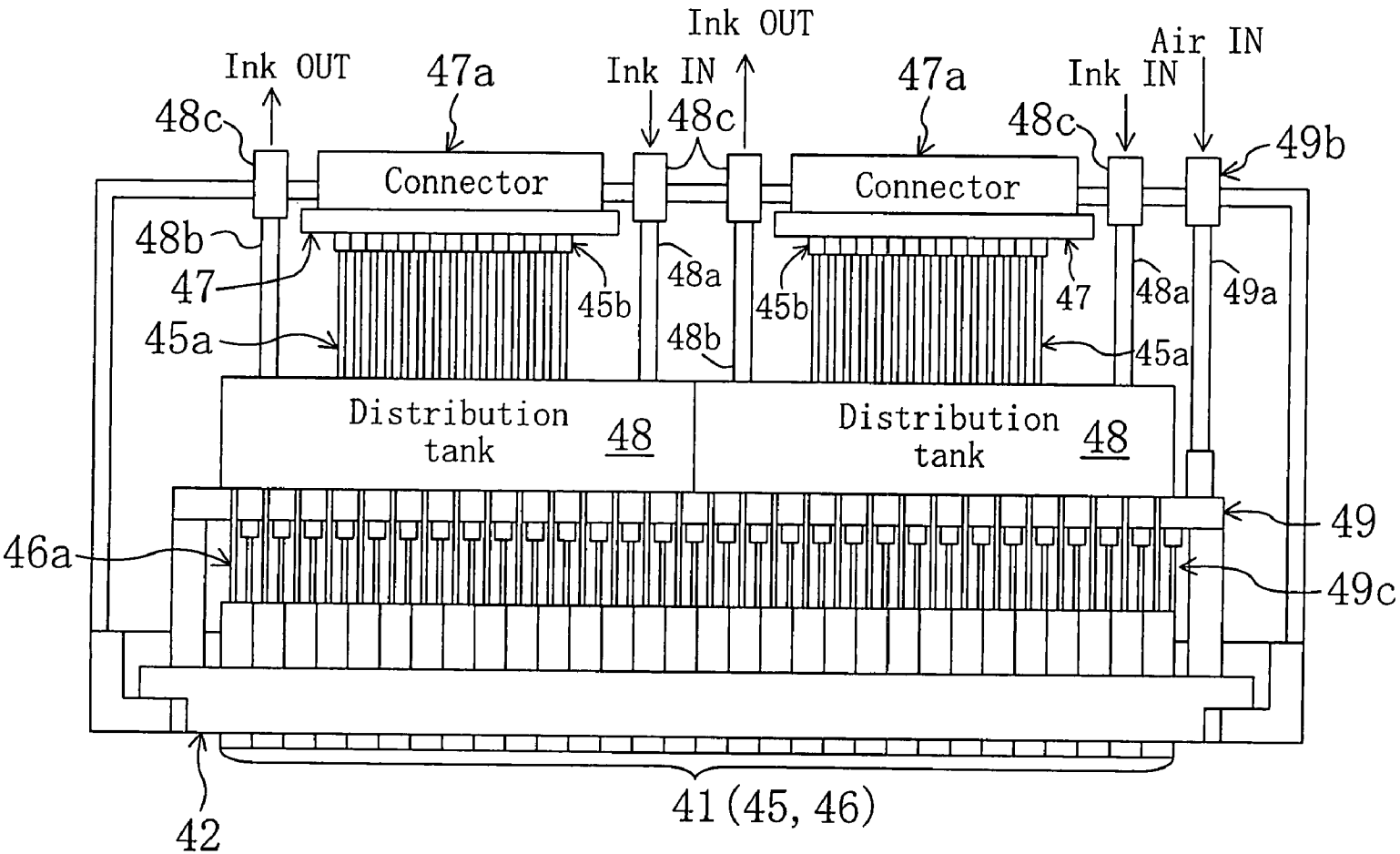
FIG. 7 shows a general structure of a line head.

The line head 4 includes, as shown in FIGS. 4 and 7, two relaying boards 47. FIG. 7 schematically shows the line head 4 of FIG. 4.

Both longitudinal ends of the base plate 42 of the line head 4 are provided with side frames 42*b* standing thereon. The two relaying boards 47 are supported by the side frames 42*b*. The two relaying boards 47 are arranged side by side along the longitudinal direction of the base plate 42 to bridge between the upper sides of the two side frames 42*b*.

The driver board 45 attached to each head base 41 is connected to the relaying boards 47 through a FPC 45*a*. It should be noted that a part of the FPC 45*a* is not shown in FIG. 4. The FPC 45*a* is detachably connected to the relaying board 47 by connectors 45*b*. Among the head bases 41 fixed to the base plate 42, head bases 41 provided in one longitudinal half of the base plate 42 are connected to one of the relaying boards 47, and head bases 41 provided in the other longitudinal half of the base plate 42 are connected to the other of the relaying boards 47. That is, the half of the driver boards 45 of all the head bases 41 fixed to the base plate 42 are connected to one of the relaying boards 47, and the remaining half of the driver boards 45 are connected to the other one of the relaying boards 47.

Figure 13:
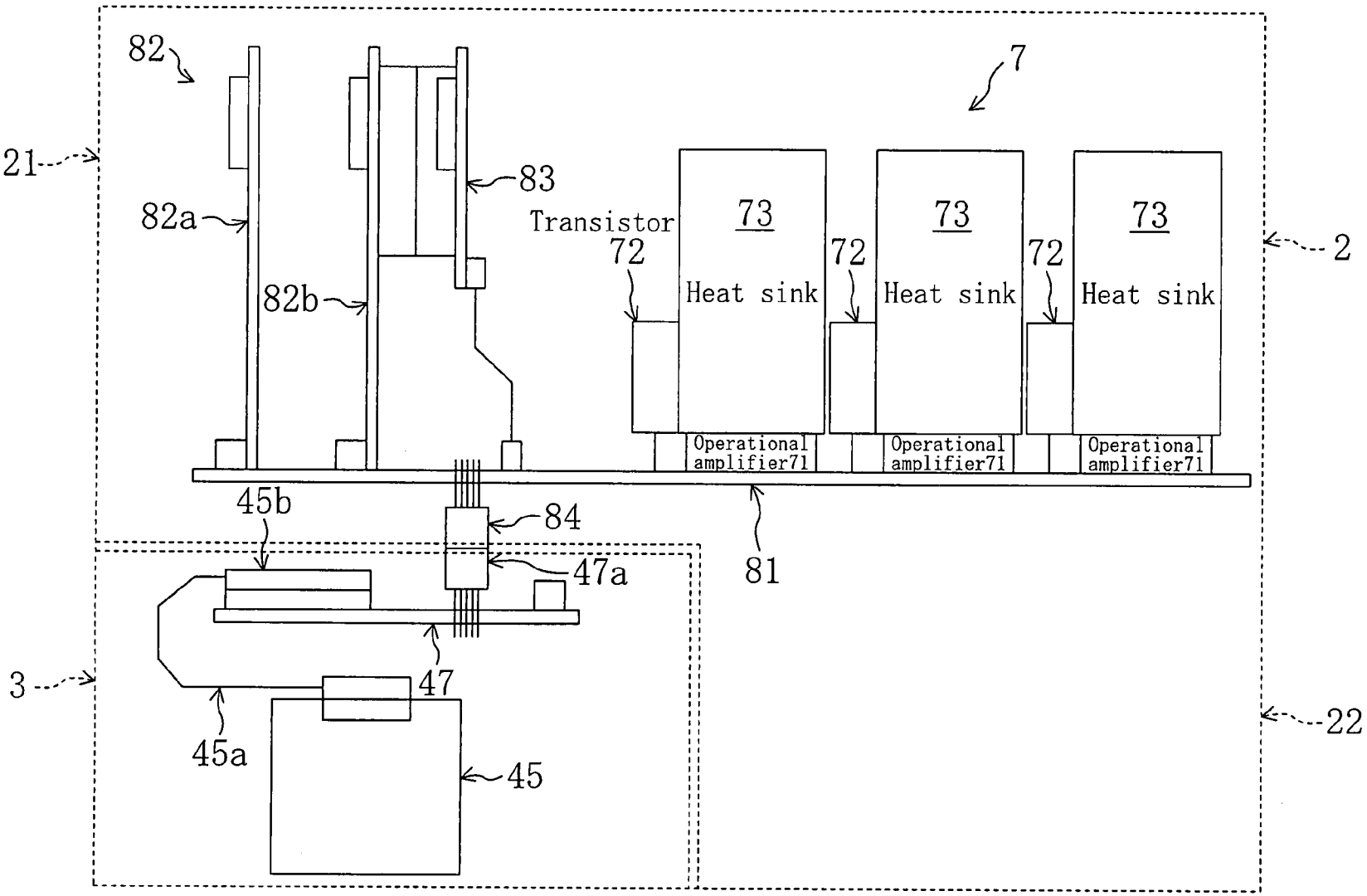
FIG. 13 is an electric circuit structure of an inkjet head.

Each of the two relaying boards 47 has a connector 47*a*, which is connected to a connector 84 of the main box 2 (see FIG. 13). The connector 47*a* is provided on the upper surface of the head box 3 so as to face upward as shown in FIG. 4.

The wires from the driver boards 45 are gathered at the relaying boards 47 and then connected to the main box 2 by the connectors 47*a* of the relaying boards 47. Thus, electrical connection between the head box 3 (the line head 4) and the main box 2 is established only by the two connectors 47*a*. As a result, attachment/detachment of the head box 3 to/from the main box 2 is readily achieved as compared with a case where the driver boards 45 are connected to the main box 2 on a one-by-one basis. That is, the maintainability of the head box 3 is improved.

The driver boards 45 and the relaying boards 47 are freely connectable and disconnectable with each other by the connectors 45*b* of the FPC 45*a*. Thus, the head base 41 is independently detachable from the base plate 42 in an easy manner. As a result, the maintainability of the head box 3 is further improved.

The line head 4 includes two distribution tanks 48 and one air manifold 49 (not shown in FIG. 4).

The two distribution tanks 48 are provided on the back surface of the line head 4 (i.e., the surface of the line head 4 onto which the main box 2 is attached) side by side along the longitudinal direction of the line head 4 and supported by the side frames 42*b*.

The air manifold 49 is provided on the front surface of the line head 4 (i.e., a surface opposite to the surface onto which the main box 2 is attached) so as to extend in the longitudinal direction of the line head 4 and is supported by the side frames 42*b*.

A supply ink tube 48*a* and a drain ink tube 48*b* are connected to each of the two distribution tanks 48. The supply ink tube 48*a* is provided for supplying ink from the ink tank 13 to each distribution tank 48. The drain ink tube 48*b* is provided for exhausting the ink from the nozzle head 6 for the purpose of removing air bubbles from the nozzle head 6 or for other purposes.

Each of the ink tubes 48*a* and 48*b* is provided with an ink coupler 48*c*, which is connected to an ink supply system incorporated in the ink section of the main box 2. With this structure, the line head 4 has four ink couplers 48*c* in total: two ink couplers 48*c* as supply couplers and two ink couplers 48*c* as drain couplers. These ink couplers 48*c* are horizontally provided on the back surface side of the head box 3 as shown in FIG. 4.

The sub tank 46 attached to the head base 41 is connected to the two distribution tanks 48 through ink tubes 46*a*. Among the head bases 41 fixed to the base plate 42, the sub tanks 46 of the head bases 41 provided in one longitudinal half of the base plate 42 are connected to one of the two distribution tanks 48, and the sub tanks 46 of the head bases 41 provided in the other longitudinal half of the base plate 42 are connected to the other one of the two distribution tanks 48. That is, a half of all the sub tanks 46 fixed to the base plate 42 are connected to one of the distribution tanks 48, and the remaining half of the sub tanks 46 are connected to the other one of the distribution tanks 48.

With the above structure, ink is supplied from the ink tank 13 to the nozzle head 6 through the ink tubes 13*a* and 48*a*, the distribution tanks 48, the ink tubes 46*a* and the sub tanks 46.

A branched air tube 49*a* which is branched into two tubes at an intermediate position (see FIG. 4) is connected to the air manifold 49. The air tube 49*a* is provided with an air coupler 49*b* which is connected to an air supply system incorporated in the ink section of the main box 2. The air coupler 49*b* is horizontally provided on the back surface side of the head box 3 as are the ink couplers 48*c*.

Each head base 41 is connected to the air manifold 49 through an air tube 49*c*. With this structure, dry air is supplied from the air supply 15 to the piezoelectric element 67*b* incorporated in the head base 41 and to the vicinity thereof through the air tubes 15*a* and 49*a*, the air manifold 49 and the air tube 49*c*. With such supply of dry air, occurrence of a major defect in the piezoelectric element 67*b* is prevented. The piezoelectric element 67*b* has a large number of defects, such as very small cracks and holes, or the like. If a high electric field is applied to the piezoelectric element 67*b* in the presence of moisture, a large electric current flows through a lead compound at a defect and the vicinity thereof, so that the defect area is broken by Joule heat to form a large hole. Especially, since the piezoelectric element 67*b* of this embodiment is formed by a thin film, there is a possibility that a large defect penetrating through the element 67*b* is generated due to breakage of a defect. In view of such, dry air is supplied to the piezoelectric element 67*b* and the vicinity thereof, such that moisture which is a cause of occurrence of a defect is removed. As a result, the lifespan of the piezoelectric element 67*b*, i.e., the period that the piezoelectric element 67*b* normally operates, is increased.

As described above, the distribution tanks 48 and the air manifold 49 are provided to the head box 3, whereby connections of the ink system and the air system between the head box 3 and the main box 2 are established only by the ink coupler 48*c* and the air coupler 49*b*. With this structure, attachment/detachment of the head box 3 to/from the main box 2 is readily achieved.

(Change of Print Width)

As described above, the line head 4 includes two relaying boards 47, each of which has the connector 47*a*, and two distribution tanks 48. With this structure, the print width of the line head 4 (the inkjet head 11), i.e., the print width in the width direction of the recording medium 12, can readily be changed.

Figure 8:
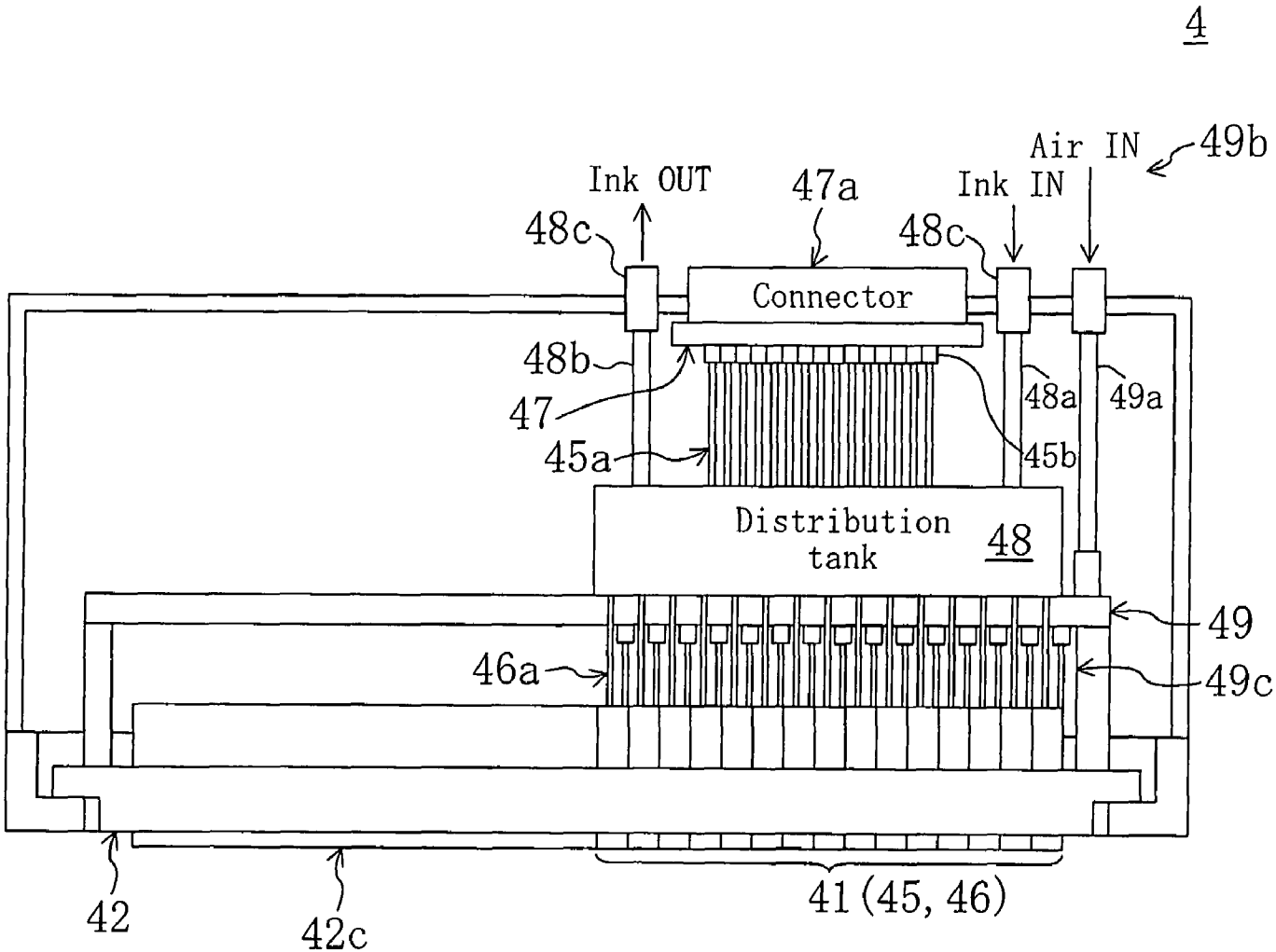
FIG. 8 shows a general structure of a line head with a shortened substantial length.

The print width of the line head 4 is changed by changing the number of head bases 41 fixed to the base plate 42. Specifically, the number of head bases 41 is reduced to a half of the maximum number of the head bases 41 fixable to the base plate 42, whereby the print width is reduced to a half of the maximum print width. As shown in FIG. 8, 15 head bases 41 are attached to one longitudinal half of the base plate 42 to which 30 head bases 41 can be attached at the maximum. Since there are 15 head bases 41, the driver boards 45 attached to the head bases 41 are all connected to one of the two relaying boards 47. The other relaying board 47 can be omitted. Likewise, the sub tanks 46 attached to the head bases 41 are all connected to one of the two distribution tanks 48. The other distribution tank 48 can be omitted. It should be noted that, as described in the aforementioned example, each head base 41 is connected to the air manifold 49 through the air tube 49*c*.

The substantial length of the line head 4 is decreased by reducing the number of the head bases 41 attached to the base plate 42. That is, a line head (recording device) is structured to adapt to a recording medium 12 having a small width (see the broken line of FIG. 1).

As described above, the number of the head bases 41 (nozzle heads 6) mounted on the line head 4 can be changed without changing the components of the base plate 42, or the like. As a result, recording device which are adapted to recording media 12 having different widths can be manufactured according to customer needs while the number of parts commonly used among different types of recording devices is increased.

In the case where the number of the head bases 41 attached is smaller than the maximum number, the opening 42*a* of the base plate 42 is left opened. Therefore, a covering member 42*c* is preferably provided to a portion of the opening 42*a* of the base plate 42 to which the head base(s) 41 is not attached. The opening 42*a* is closed by the covering member 42*c*, such that introduction of dusts, and the like, into the head box 3 is prevented.

(Variation of Inkjet Head Structure)

Figure 9:
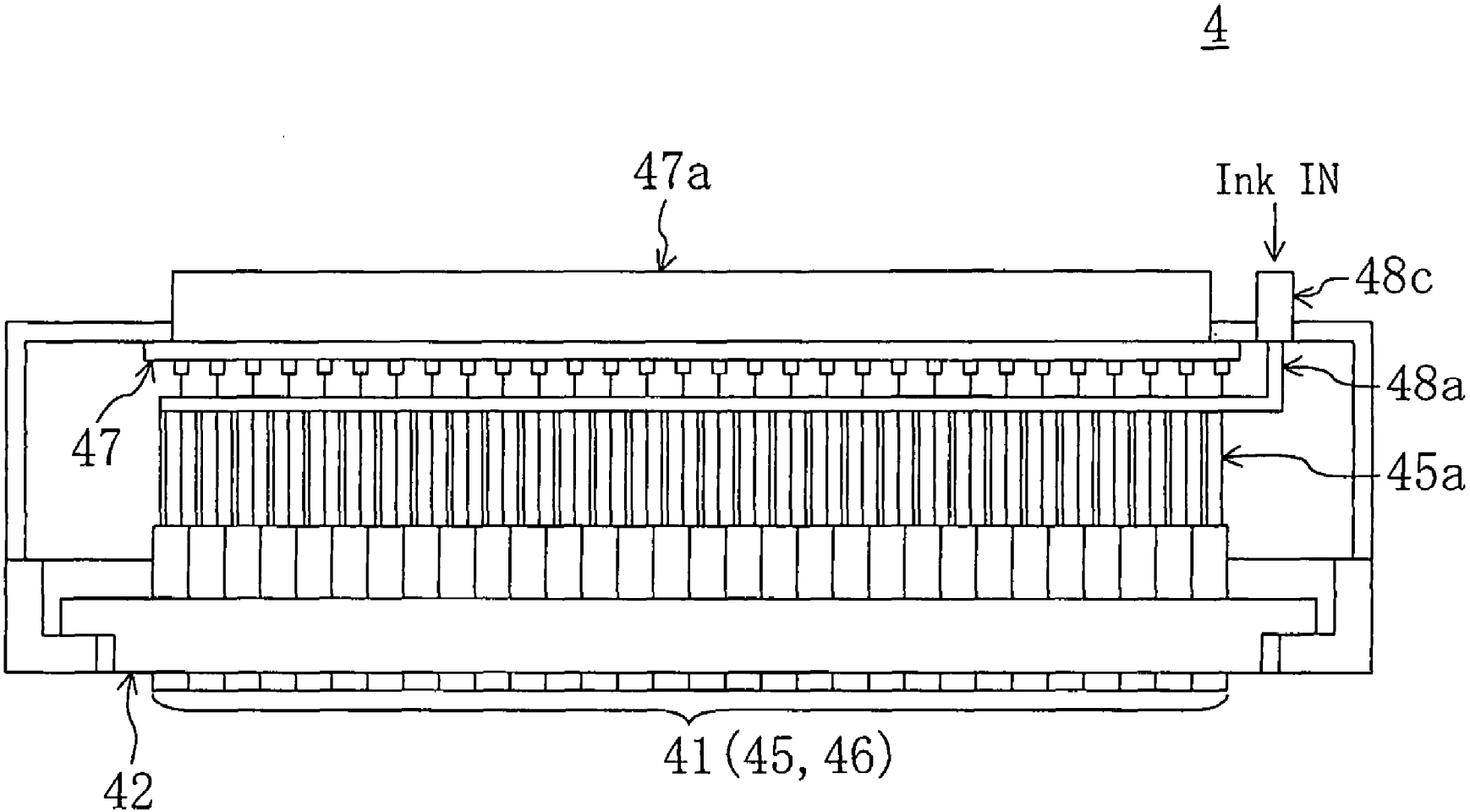
FIG. 9 shows an alternative general structure of a line head, which is different from that of FIG. 7.

The number of relaying boards 47 of the line head 4 may be only one as shown in FIG. 9 instead of providing two (or more) relaying boards. The line head 4 shown in FIG. 9 includes only one relaying board 47 which has a connector 47*a* for connection to the main box 2. The head bases 41 (the driver boards 45) attached to the base plate 42 are all connected to the relaying board 47 through the FPC 45*a*.

In the line head 4 having the above structure, electrical connection between the head box 3 and the main box 2 is established by the connector 47*a* as described above. Thus, attachment/detachment of the head box 3 to/from the main box 2 is readily achieved.

In the example illustrated in FIG. 9, the drain ink tube 48*b* is omitted, and the branched ink tube 48*a* is directly connected to the sub tanks 46 of the head bases 41. However, in the case where a drain ink tube 48*b* is provided, it is necessary to provide a distribution tank 48. In the example of this variation where a plurality of separate relaying boards 47 are not provided, the number of distribution tanks 48 may be only one. It should be noted that, in FIG. 9, illustration of the air manifold 49 is omitted.

(Attachment of Head Box 3 to Main Box 2)

As described above, the head box 3 includes two connectors 47*a*, four ink couplers 48*c* and one air coupler 49*b*. Among these elements, the two connectors 47*a* are provided on the upper surface of the head box 3 so as to face upward. The four ink couplers 48*c* and the air coupler 49*b* are horizontally provided on the side surface (back surface) of the head box 3 (see FIG. 4).

When the head box 3 is attached to the main box 2, the connectors 47*a* and the couplers 48*c* and 49*b* are respectively connected to an electric system connector 84 (see FIG. 13), an ink system coupler (not shown) and an air system coupler (not shown) which are provided in the main box 2. The electric system connector 84 of the main box 2 is provided on the lower surface of the circuit section 21 so as to face downward. Although not shown, the ink system coupler and the air system coupler are horizontally provided at the front surface of the ink section 22 (a surface of the main box 2 to which the head box 3 is attached).

The main box 2 has a head box slider 23 used for attaching the head box 3 as shown in FIG. 3. The head box slider 23 is provided at the cut-away space of the main box 2. The head box slider 23 is provided on the front surface of the ink section 22. The head box slider 23 includes a base 23*a* extending along the longitudinal direction of the main box 2 and engagement arms 23*b* horizontally extending from both longitudinal ends of the base 23*a*. The base 23*a* faces and abuts the back surface of the head box 3. The engagement arms 23*b* are engaged with the side surfaces of the head box 3. The head box slider 23 is capable of moving upward and downward relatively to the main box 2. The head box 3 is capable of moving relatively to the head box slider 23 in a horizontal direction while being kept engaged with the engagement arms 23*b* of the head box slider 23.

Next, the process of attaching the head box 3 to the main box 2 is described with reference to FIGS. 3 and 10. In the first place, the both side surfaces of the head box 3 are engaged with the engagement arms 23*b* of the head box slider 23. The head box 3 is then horizontally slid till the head box 3 abuts the base 23*a* of the head box slider 23 while the engagement of the head box 3 and the engagement arms 23*b* is maintained (see step P11 of FIG. 10). In the meantime, the ink couplers 48*c* and the air coupler 49*b* which are provided on the back surface of the head box 3 are connected to the ink system couplers and the air system coupler which are provided in the ink section 22 of the main box 2.

Figure 10:
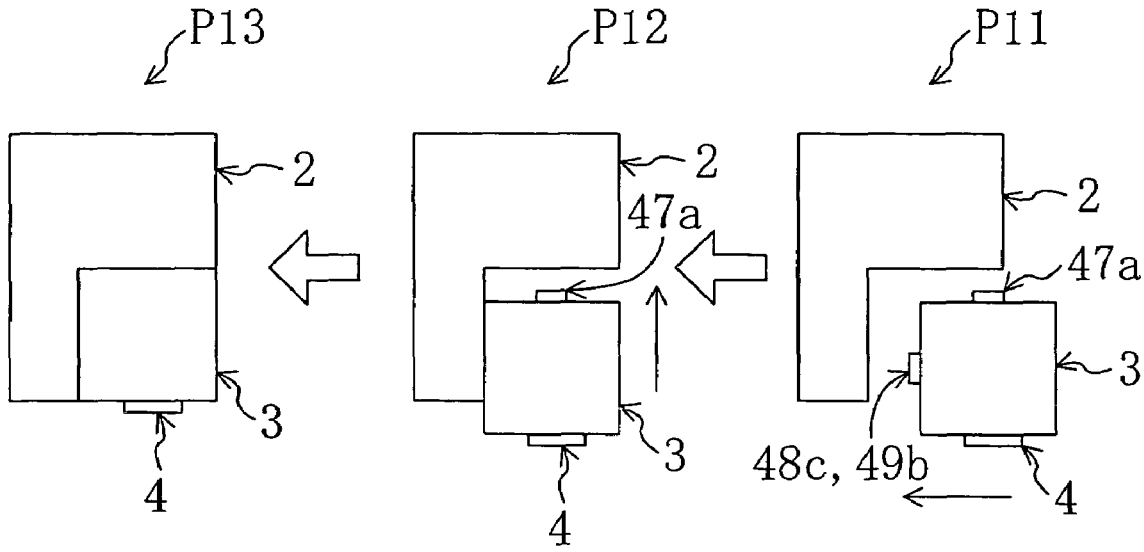
FIG. 10 illustrates a process of assembling an inkjet head.

Then, the head box slider 23 to which the head box 3 has been attached is moved upward till the upper surface of the head box 3 abuts the lower surface of the circuit section 21 (see step P12 of FIG. 10). In the meantime, the connector 47*a* provided on the upper surface of the head box 3 is connected to the connector 84 provided in the circuit section 21 of the main box 2.

Through the above process, the head box 3 is attached to the main box 2, while connections of the connector 47*a*, the ink couplers 48*c* and the air coupler 49*b* are completed (see step P13 of FIG. 10).

As described above, in the inkjet head 11 having the above-described structure, the direction of connection of the electric system between the head box 3 and the main box 2 (vertical direction) and the direction of connection of the systems other than the electric system (the ink system and the air system) between the head box 3 and the main box 2

(horizontal direction) are different from each other. Specifically, these two different connection directions are orthogonal to each other. With this structure, the connection of the electric system and the connections of the ink system and the air system are securely established.

The ink couplers 48*c* are provided on the back surface of the head box 3, and the connector 47*a* is provided on the upper surface of the head box 3. Thus, the ink couplers 48*c* are provided at a level lower than the connector 47*a*. With this structure, even if ink leaks from the ink couplers 48*c*, contamination of the connector 47*a* with the ink is surely avoided. This is effective in preventing a short-circuit and connection failure.

Although only one air coupler 49*b* is provided in the above example, two or more air couplers 49*b* may be provided. In such a case, it is possible that some of the air couplers 49*b* are used for introduction of air, while the other air couplers 49*b* are used for exhaustion of air.

(Variation of Attachment)

Although in the head box 3 shown in FIG. 4, the connectors 47*a*, the ink couplers 48*c* and the air coupler 49*b* are provided on different surfaces, the connectors 47*a* and the couplers 48*c* and 49*b* may be provided on the same surface of the head box 3.

Figure 11:
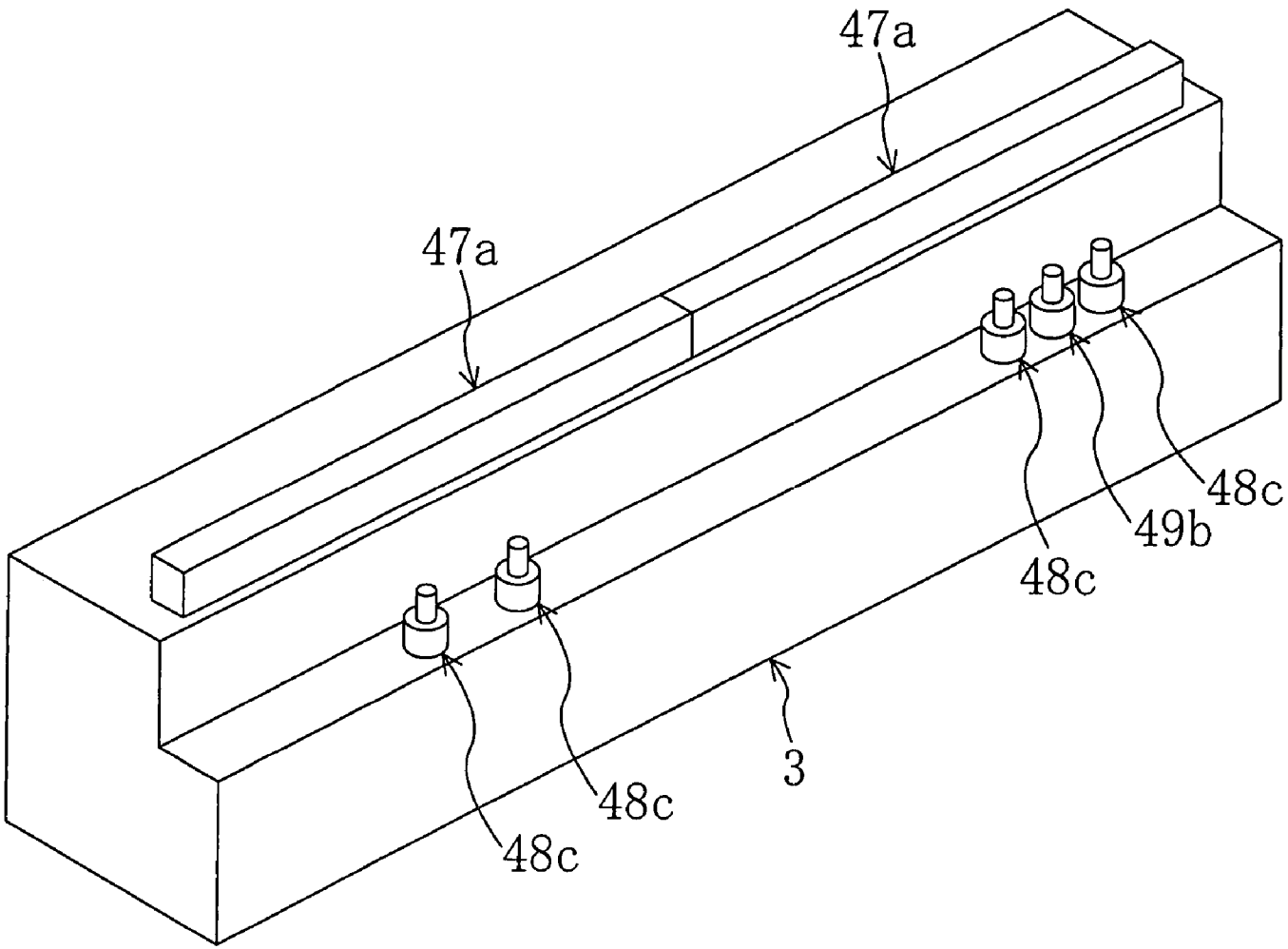
FIG. 11 is a perspective view of an alternative inkjet head, which is different from that of FIG. 4.

FIG. 11 shows an example where the connectors 47*a* and the couplers 48*c* and 49*b* are all provided on the upper surface of the head box 3. Also in the case where the connectors 47*a* and the couplers 48*c* and 49*b* are provided on the same surface, the couplers (especially, the ink couplers 48*c*) are preferably provided at a level lower than the connectors 47*a*. In view of such, in the head box 3 shown in FIG. 11, a step is provided in the upper surface section, and the connectors 47*a* are provided at the upper level while the ink couplers 48*c* and the air coupler 49*b* are provided at the lower level, so that the couplers are at a level lower than the connectors 47*a*. In the head box 3 having such a structure, connection of the electric system and connections of the ink system and air system are established when the head box 3 is vertically (one-directionally) moved to the main box 2.

Figure 12:
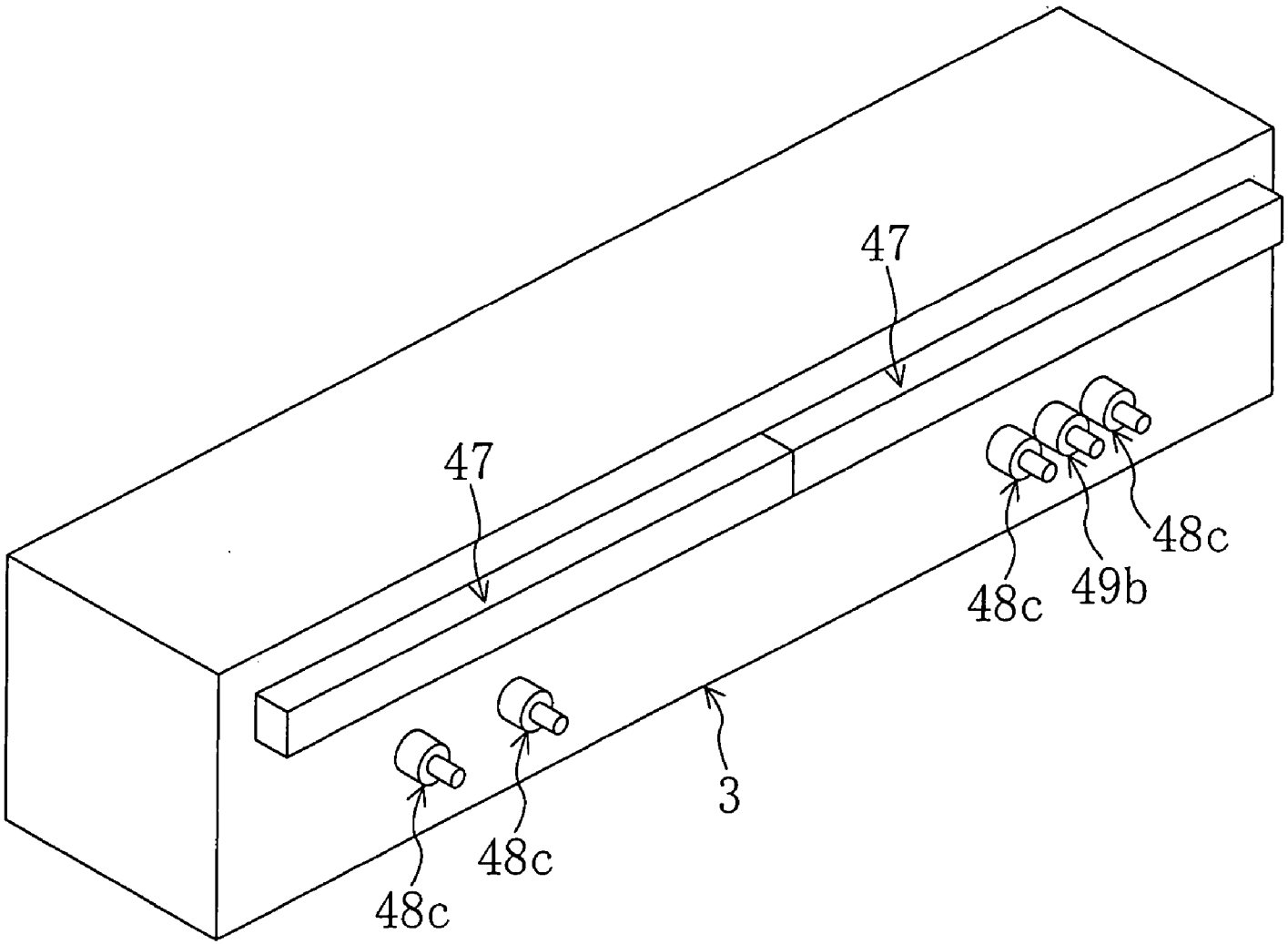
FIG. 12 is a perspective view of a still alternative inkjet head, which is different from that of FIG. 4.

FIG. 12 shows a different example where the connectors 47*a* and the couplers 48*c* and 49*b* are all provided on the back surface of the head box 3. Also in the head box 3 of this example, the couplers are preferably provided at a level lower than the connectors 47*a* as shown. In the head box 3 having such a structure, connection of the electric system and connections of the ink system and air system are established when the head box 3 is horizontally (one-directionally) moved to the main box 2.

(Structure of Electric Circuit)

FIG. 13 shows a structure of an electric circuit of each inkjet head 11. As described above, the head box 3 includes the driver boards 45 attached to the head base 41 and the relaying boards 47 to which the driver boards 45 are connected through the FPC 45*a*. Although only one driver board 45 is shown in FIG. 13, the number of the driver boards 45 is actually equal to that of the nozzle heads 6. Although only one relaying board 47 is shown in FIG. 13, there are two relaying boards 47 provided in an actual device.

The main box 2 includes a main board 81 having a connector 84 in the circuit section 21. The main board 81 includes a control board 82, a D/A converter board 83 and an amplifier board 7. The control board 82 includes an optical conversion board 82*a* which receives a light signal from the power control box 14 to output a head control signal and a piezoelectric board 82*a* for outputting head driving waveform data. The D/A converter board 83 D/A-converts the head driving waveform data. The amplifier board 7 amplifies the head driving waveform data. The connector 84 of the main board 81 is coupled to the connector 47*a* of the head box 3.

Figure 14:
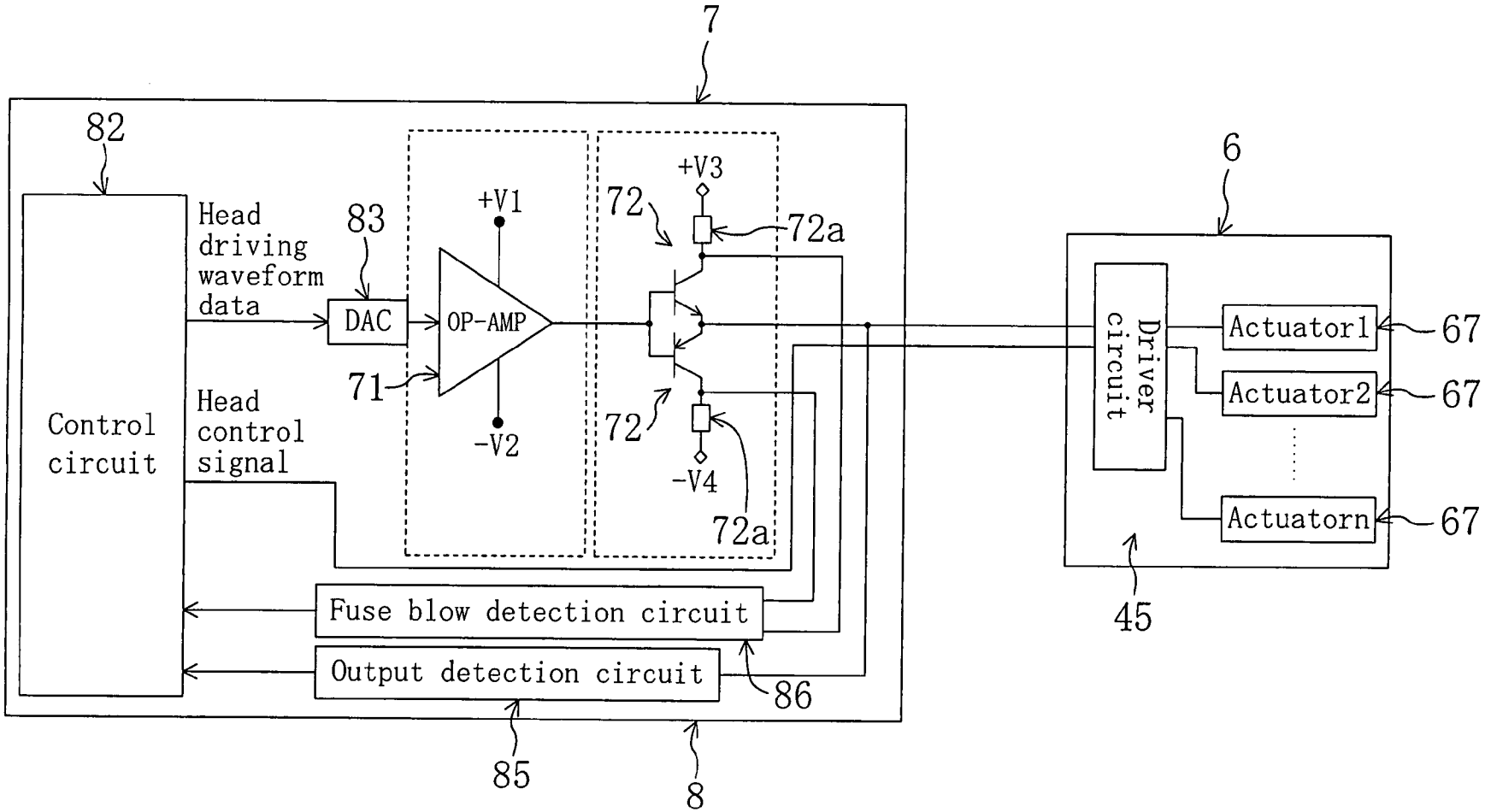
FIG. 14 is an electric circuit structure corresponding to one nozzle head.
Figure 15:
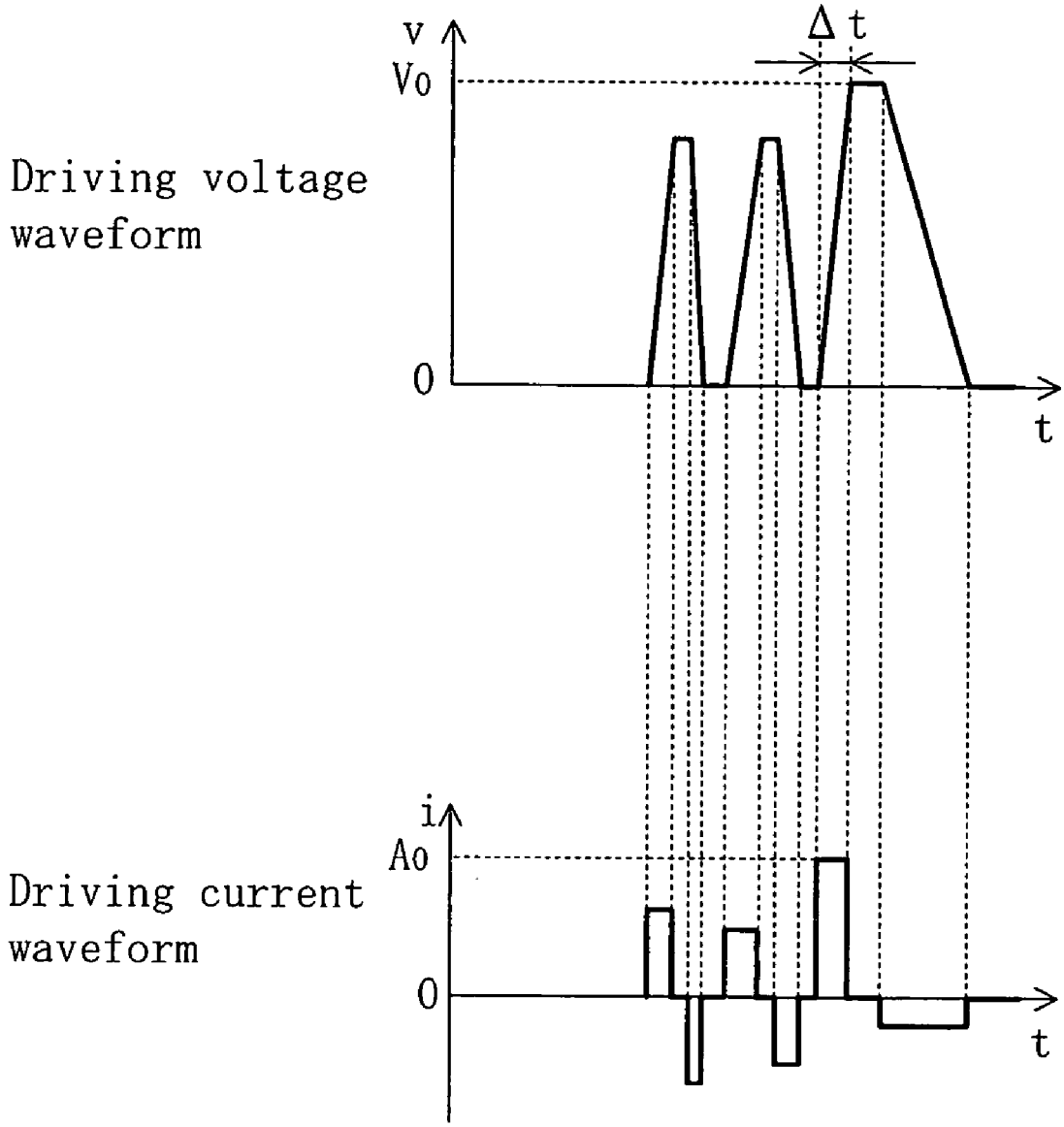
FIG. 15 is an example of a driving voltage waveform and a driving current waveform corresponding thereto.

FIG. 14 shows circuit components necessary for one nozzle head 6 (including a plurality of piezoelectric actuators 67). The head driving waveform data output from the control board 82 is input to an operational amplifier 71 of the amplifier circuit 7 through the D/A converter 83 and amplified by the operational amplifier 71. FIG. 15 shows an example of driving voltage and current waveforms of the nozzle head 6. In the inkjet head 11 of this embodiment, the voltage waveform of high voltage ($V_0$: generally 30 V or higher) and high slew rate ($\Delta V/\Delta t$: in FIG. 15, $V_0/\Delta t$) is necessary in view of the ejection characteristics of ink. Thus, the operational amplifier 71 used in the amplifier circuit 7 has to achieve a high voltage and a high slew rate. Therefore, there are only a limited number of types of such amplifiers. For example, a large CAN-type operational amplifier 71*a* shown in FIG. 16 or a vertically mounted operational amplifier 71*b* of a resin mold type shown in FIG. 22 can be employed.

Each piezoelectric actuator 67 of the nozzle head 6 functions as a capacitor. Thus, it is necessary to supply a large electric current ($A_0$) to the nozzle head 6 in order to drive a large number of piezoelectric actuators at one time (see the current waveform of FIG. 15). To this end, a current buffer (emitter follower type) which includes pnp-type and npn-type transistors 72 is connected to the operational amplifier 71. The electric current is amplified by this current buffer, and a head driving waveform is input to the driver circuit. The heat value of the transistors 72 which constitute the current buffer is relatively large, and therefore, a large heat sink 73 is necessary for cooling the transistors 72. The power supplies (+V1, −V2, +V3, −V4) connected to the operational amplifier 71 or the current buffer may be provided inside the main box 2. Alternatively, the power supplies may be provided outside the main box 2. (In this case, for example, electric power can be supplied through a transmission line to the operational amplifier 71 or the current buffer.)

The driver circuit 45 receives a head control signal from the control circuit 82. The driver circuit 45 selectively supplies a head driving waveform to the piezoelectric actuators 67 based on the head control signal.

Thus, one large operational amplifier and one large heat sink are necessary for one nozzle head 6, and these components have to be mounted on the amplifier board 7. A relaying board 47 to which a large number of nozzle heads 6 (driver circuits 45) are connected is connected to the amplifier board 7. Accordingly, sets of the large operational amplifier 71 and the current buffer including a large heat sink have to be mounted on one amplifier board 7 as much as the number of the nozzle heads 6 connected to the relaying board 47. As a result, the size (area) of the amplifier board 7 disadvantageously increases.

Figure 16:
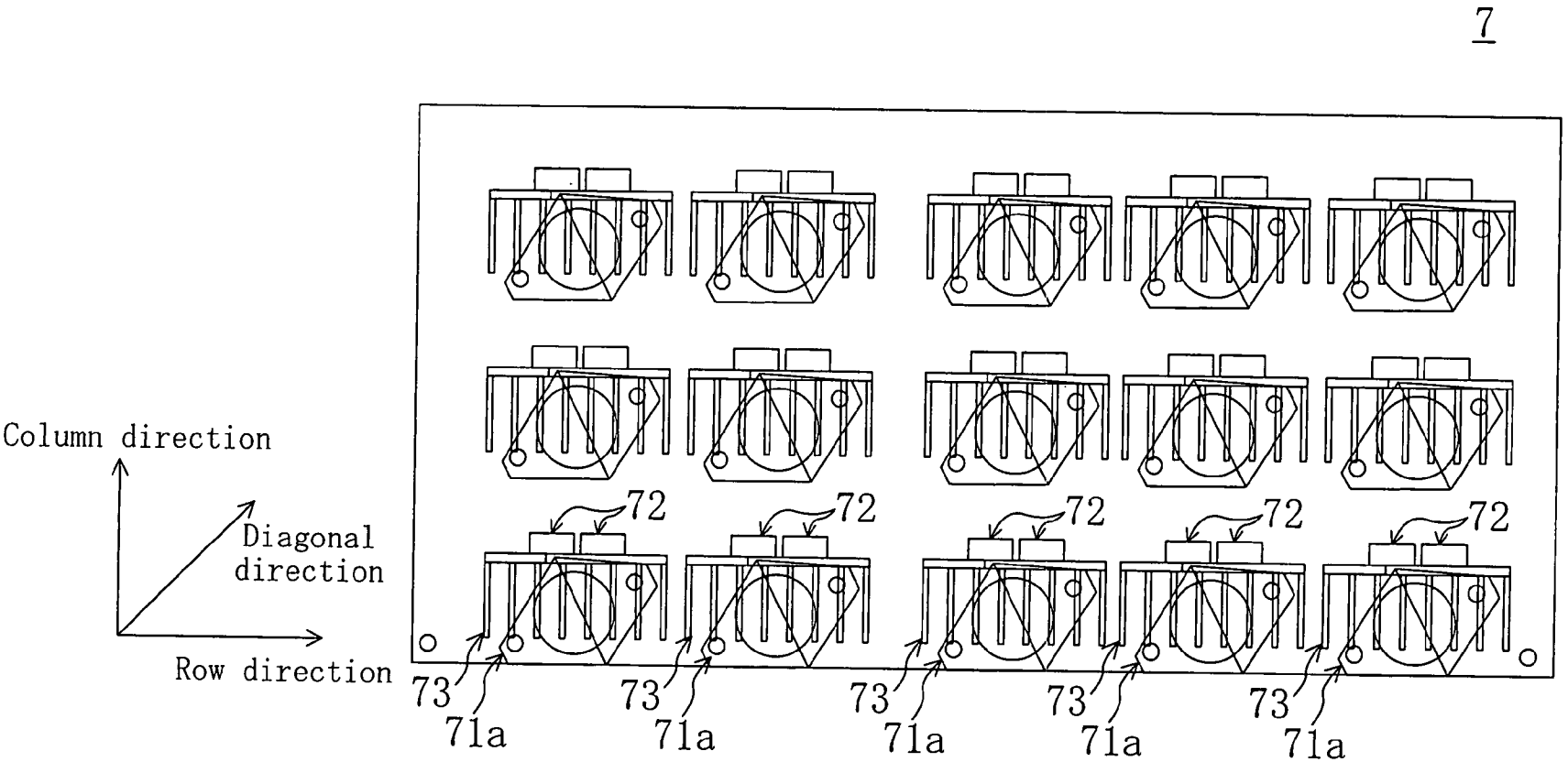
FIG. 16 is a plan view showing a board arrangement of an amplifier board.
Figure 17:
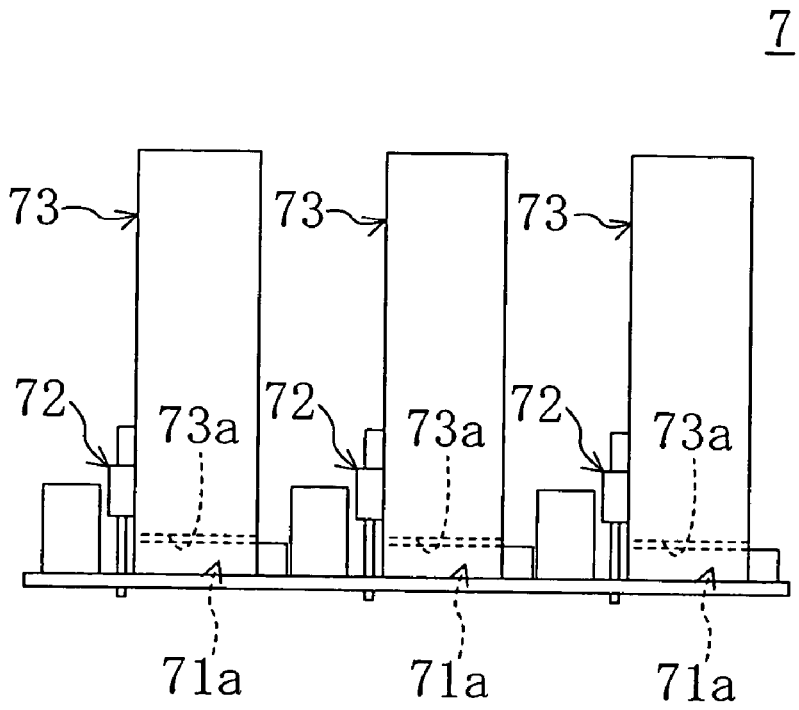
FIG. 17 is a side view showing a board arrangement of an amplifier board.

In view of the above, this embodiment achieves reduction in the size (area) of the amplifier board 7 by employing the structure described below. FIGS. 16 and 17 illustrate a board arrangement of the amplifier board 7 where a CAN-type operational amplifier 71*a* is employed. It should be noted that, in FIG. 16, illustration of electrolytic capacitors, connectors, etc., which are to be mounted on the amplifier board 7, is omitted.

In the case where a large number of large operational amplifiers 71*a* and large heat sinks 73 are mounted on a substrate, the increase in size (area) of the substrate cannot be avoided. Thus, according to this embodiment, the operational amplifiers 71*a* and the heat sinks 73 are vertically stacked on when they are mounted on the substrate. Specifically, a large number of operational amplifiers 71*a* (15 amplifiers 71*a* in the example of FIG. 16) are arranged over the amplifier board 7. At this step, the operational amplifiers 71*a*, each of which has a rhombic shape, are arranged such that the long diagonal line has an angle with the row direction. With such an arrangement, the arrangement efficiency is high as compared with a case where the operational amplifiers 71*a* are arranged such that the long diagonal line is in parallel to the row direction. Thus, the area of the amplifier board 7 can be reduced.

Figure 18:
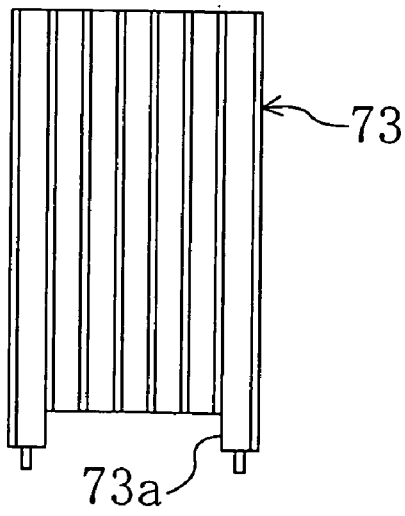
FIG. 18 is a front view of a heat sink.

The heat sink 73 has a cut-away recess 73*a* at the lower end as shown in FIG. 18. The heat sink 73 is provided over the operational amplifier 71*a* such that the operational amplifier 71*a* is placed in the recess 73*a*. With such a structure, interference between the operational amplifier 71*a* and the heat sink 73 is avoided. On a side surface of each heat sink 73, two transistors 72 which constitute a current buffer are provided.

As described above, the large operational amplifier 71*a* and the large heat sink 73 are vertically stacked, whereby the size (area) of the amplifier board 7 is decreased.

(Variation 1)

Figure 19:
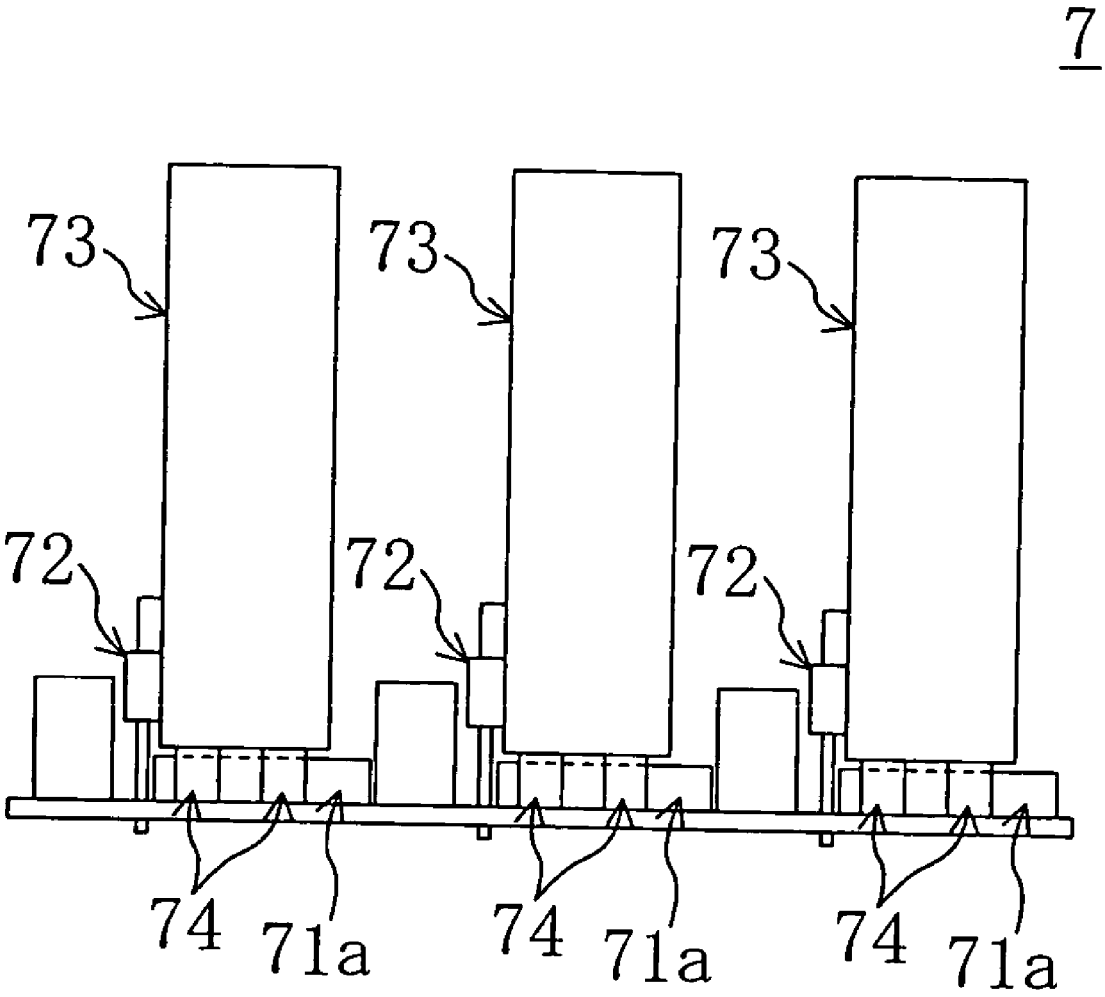
FIG. 19 is a side view of an amplifier board having a structure different from that of FIG. 17.

FIG. 19 shows an amplifier board 7 of variation 1. The amplifier board of FIG. 19 is the same as the amplifier board of FIG. 17 in that an operational amplifier 71*a* and a heat sink 73 are vertically stacked. However, the amplifier board 7 of variation 1 (FIG. 19) is different from the amplifier board of FIG. 17 in that the heat sink 73 does not have a recess 73*a*. In the amplifier board 7 of variation 1, the heat sink 73 is fixed to the board 7 through spacers 74 provided at both sides of the operational amplifier 71*a*. (In FIG. 19, the spacer 74 provided at one side of the operational amplifier 71*a* is only shown, while illustration of the spacer 74 provided at the other side is omitted.) In variation 1, the heat sink 73 is indirectly fixed to the amplifier board 7, whereas the heat sink 73 is directly fixed to the amplifier board 7 in the case where the heat sink 73 has a recess 73*a*. Thus, the heat sink 73 having a recess 73*a* is preferable in view of the stability of fixation of the heat sink 73.

(Variation 2)

Figure 20:
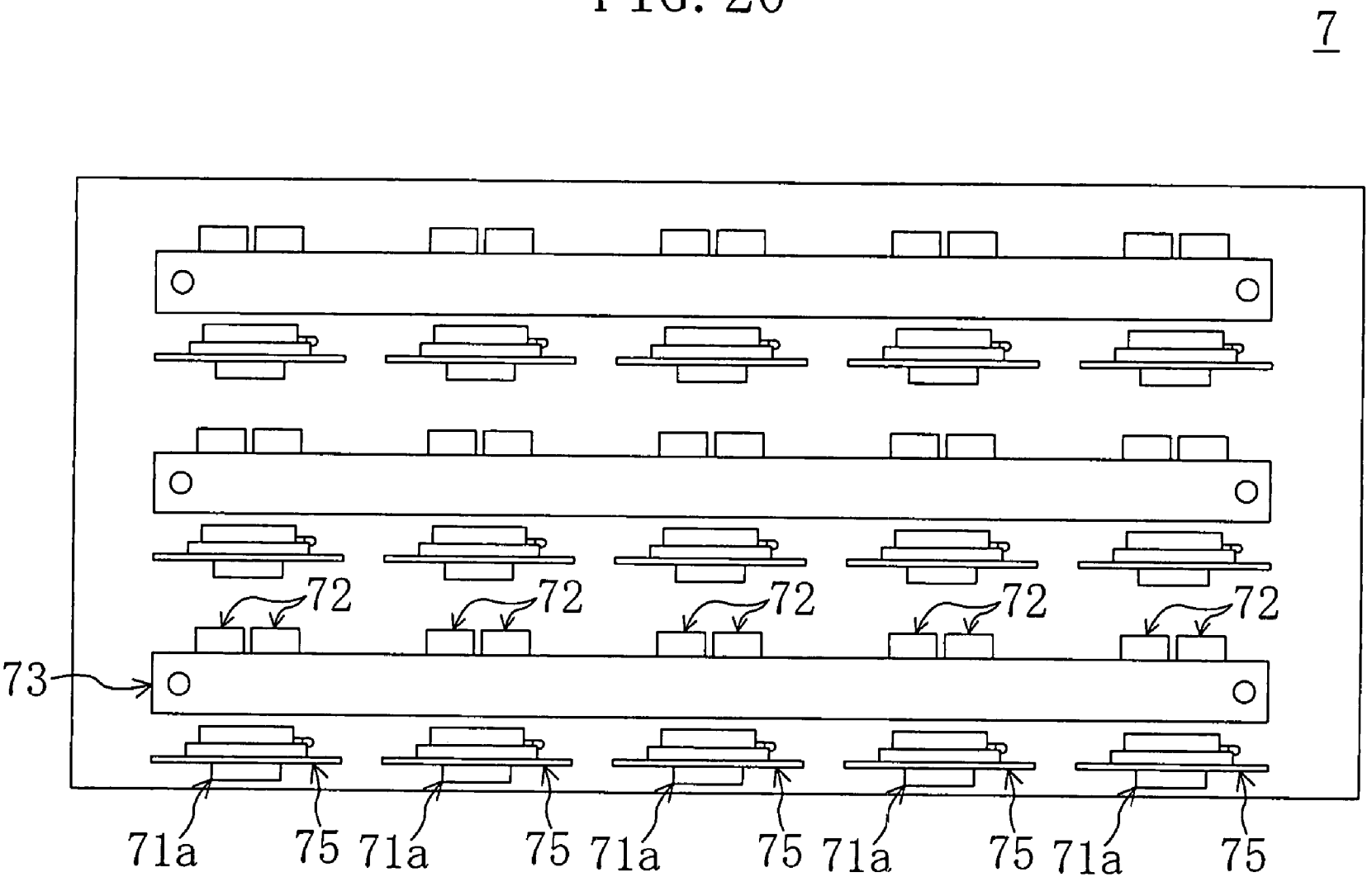
FIG. 20 is a side view of an amplifier board having a structure different from that of FIG. 16.
Figure 21:
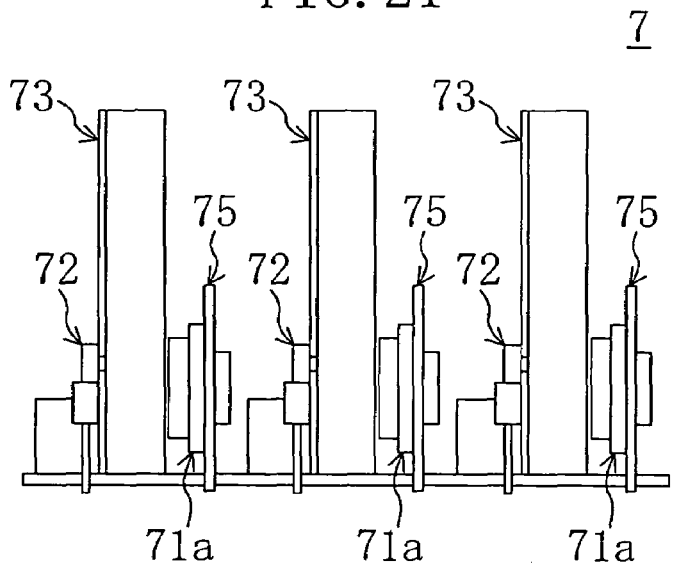
FIG. 21 is a side view of an amplifier board having a structure different from that of FIG. 17.

FIGS. 20 and 21 show an amplifier board 7 of variation 2. In this example, CAN-type operational amplifiers 71*a* are mounted on sub boards 75 which are different from the amplifier board 7, and the sub boards 75 are vertically distributed over the amplifier board 7. With such a structure, the operational amplifiers 71*a* and the heat sinks 73 are arranged in parallel to each other along a horizontal direction. Since the operational amplifiers 71*a* and the heat sinks 73 are arranged in parallel to each other along a horizontal direction, the thickness of the heat sinks 73 has to be adjusted. Each heat sink 73 has an elongated shape and is common among a plurality of current buffers (transistors 72) in FIG. 20, but the present invention is not limited thereto. Every one of the current buffers may be provided with one heat sink 73 as shown in FIG. 16.

(Variation 3)

Figure 22A:
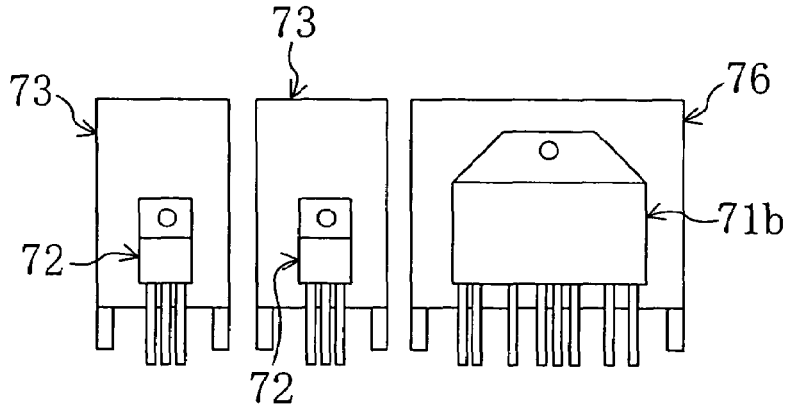
FIG. 22A is a front view showing a conventional board arrangement where operational amplifiers of vertical-mount type are employed.
Figure 22B:
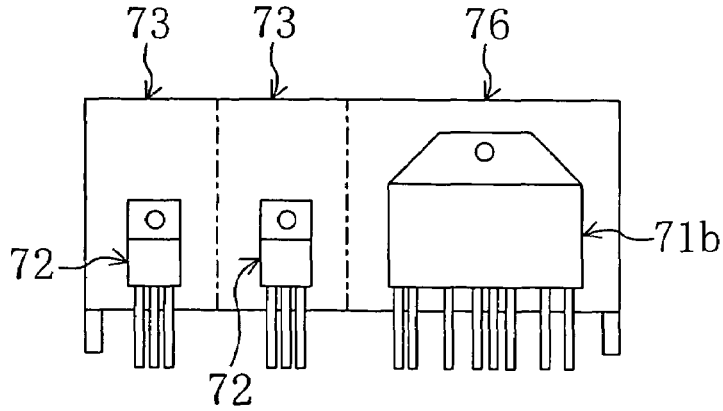
FIG. 22B is a front view showing a board arrangement of the present invention where operational amplifiers of vertical-mount type are employed.

As described above, a possible candidate of the operational amplifier 71 other than the CAN-type amplifier is a resin mold type operational amplifier 71*b* shown in FIG. 22. This operational amplifier 71*b* is of vertical mount type and has a relatively large heat value. Thus, a heat sink 76 is necessary. In this case, if the heat sink 73 of the transistor 72 and the heat sink 76 of the operational amplifier 71*b* are separately provided as shown in FIG. 22A, the heat sink 73 and the heat sink 76 cannot be placed in the vicinity of each other because of fixation of the legs of the heat sinks 73 and 76 on the board. Thus, this arrangement is disadvantageous as to the installation space. In addition, the number of legs of the heat sinks 73 and 76 increases, and therefore, this structure is disadvantageous as to routing of the board pattern. In view of such, the heat sinks 73 of the transistors 72 and the heat sink 76 of the operational amplifier 71*b* may be integrated as shown in FIG. 22B. With such a structure, it is possible to adjacently position the transistors 72 and the operational amplifier 71*b* in the vicinity of each other, and such an arrangement is advantageous in reduction of the size of the amplifier board 7. In addition, the number of the legs of the heat sink 76 is reduced, whereby this structure is also advantageous as to routing of the board pattern.

(Fuse Blow Detection Circuit)

As shown in FIG. 14, a collector of each of the transistors 72 which constitute a current buffer has a fuse 72*a* for opening a circuit on the occurrence of an overcurrent. The amplifier board 7 has an output detection circuit 85 for detecting an output from the amplifier board 7 to the driver circuit 45. A result of the detection is fed back to the control circuit 82.

As described above, in the case where the number of actuators to be driven is small (i.e., in the case where the number of nozzles from which ink is ejected is small), a required current value is small. Further, the operational amplifier 71 can provide an output if it has a small current value. Thus, in an emitter follower type current buffer, a head driving waveform is output to the driver circuit 45 through a base of the transistor 72 when the current value is small even if the fuse 72*a* is open. As a result, a fuse blow cannot be detected even when the output detection circuit 85 is provided.

In view of such, a fuse blow detection circuit 86 for detecting a fuse blow in the transistor 72 is provided separately from the output detection circuit 85. A result of the detection is input to the control circuit 82. With such a structure, a fuse blow is surely detected even when the number of nozzles that eject ink is small.

(Structure of Purge Unit)

In an inkjet recording apparatus, ink remaining on an ink ejection surface of the nozzle plate 43 (hereinafter, referred to as "nozzle surface 43*a*") is condensed because of evaporation of moisture to have high concentration and high viscosity. Accordingly, there is a possibility that the condensed ink causes clogging of the nozzles 44 or contamination of the recording medium 12. Thus, it is necessary to periodically clean the nozzle surface 43*a*, and to this end, a general inkjet recording apparatus has a cleaner.

As described above, the recording apparatus of this embodiment includes four purge units 5 (see FIGS. 1 and 2). These purge units 5 are provided at cleaning positions (external positions which deviate from the transfer position of the recording medium 12 in Y direction orthogonal to the transfer direction of the recording medium 12) with predetermined equal intervals along the transfer direction (X direction) of the recording medium 12. That is, the four purge units 5 are positioned according to the arrangement of the four inkjet heads 11. The purge units 5 are provided at a level lower than the inkjet heads 11.

Figure 23:
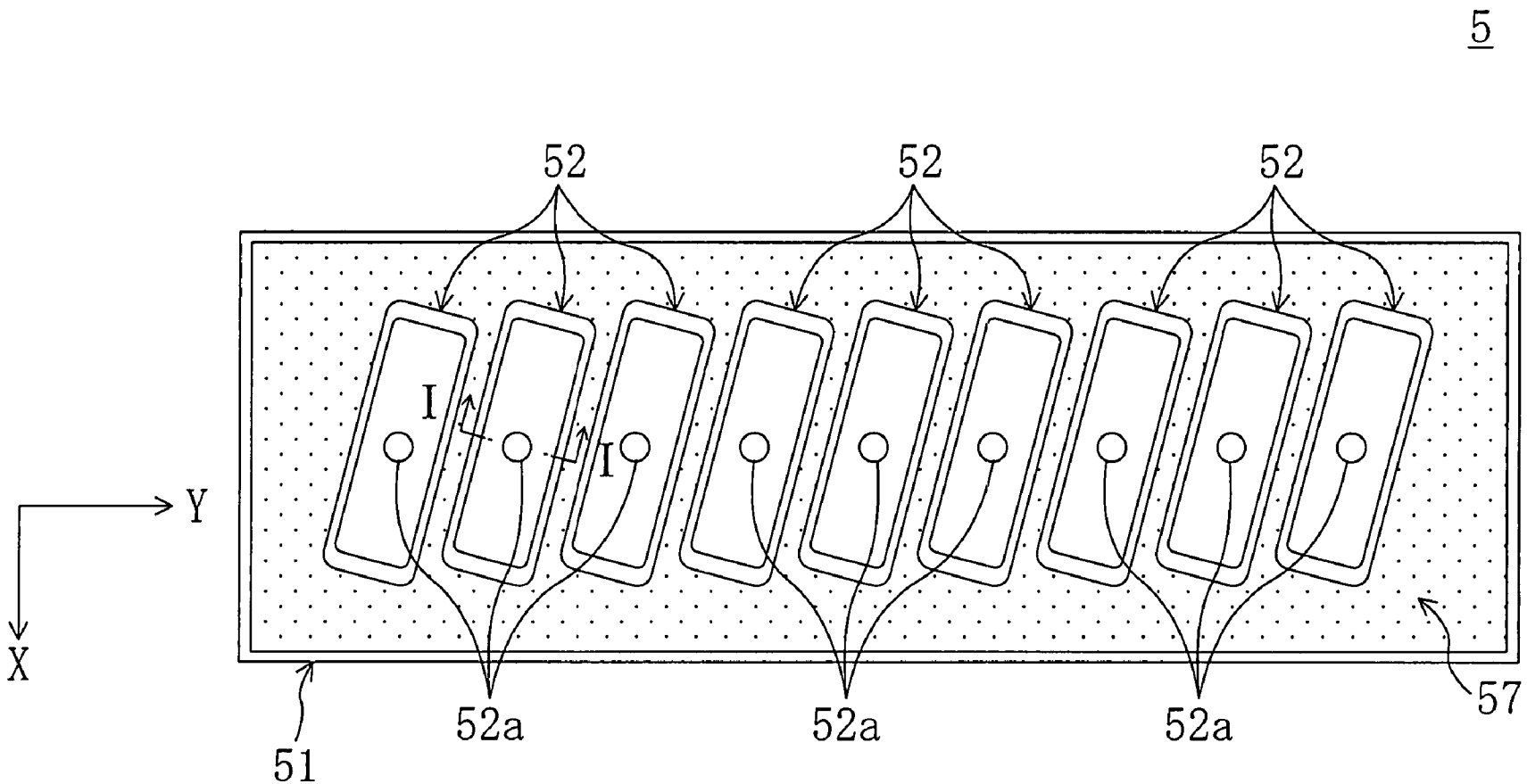
FIG. 23 is a plan view of a purge unit.
Figure 24:
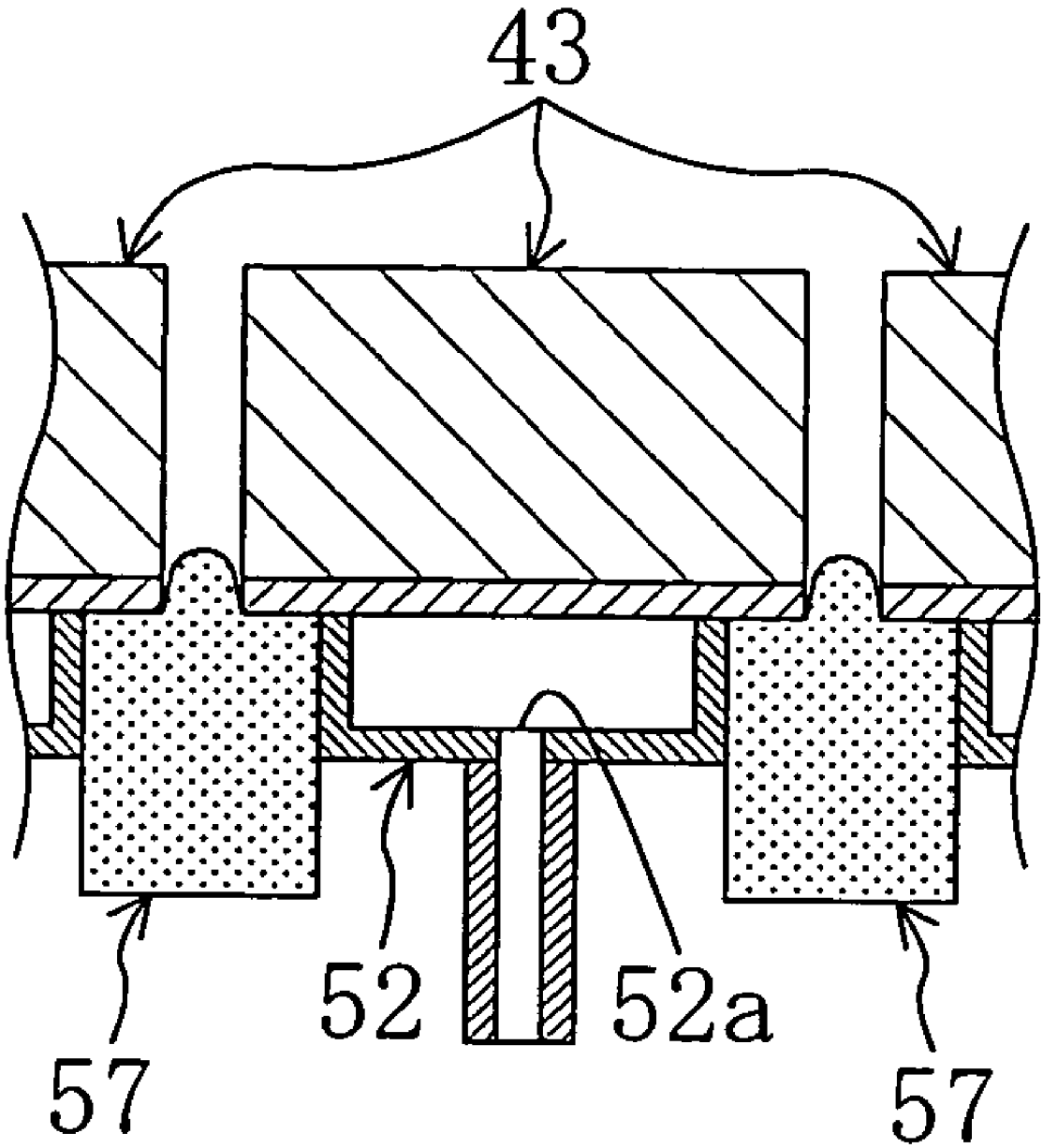
FIG. 24 is a cross-sectional view taken along line I-I of FIG. 23.

As shown in FIGS. 23 and 24, each purge unit 5 has a frame 51 extending in Y direction, a plurality of caps 52 supported by the frame 51, and a suction pump (not shown).

The caps 52 correspond to the nozzle plates 43 included in the inkjet heads 11 (see FIG. 28) and are arranged along Y direction. It should be noted that, in FIG. 23 (and FIG. 28), some of the caps 52 included in the purge unit 5 (the nozzle plates 43 included in inkjet heads) are not shown, so that the number of caps 52 shown in FIG. 23 is not equal to the number of caps 52 (and the number of nozzle plates 43) shown in FIG. 1. In this way, the caps 52 are provided to correspond to the nozzle plates 43, whereby the size of the caps 52 is decreased. As a result, each cap 52 is readily brought into close contact with the nozzle surface. (As will be described later, pressure leakage rarely occurs when the inside of the cap 52 is decompressed.)

Each cap 52 has a box-like shape with the upper face opened. The cap 52 has a through hole 52*a* which penetrates the bottom of the cap 52. The through hole 52*a* of each cap 52 is connected to the suction pump.

Figure 25:
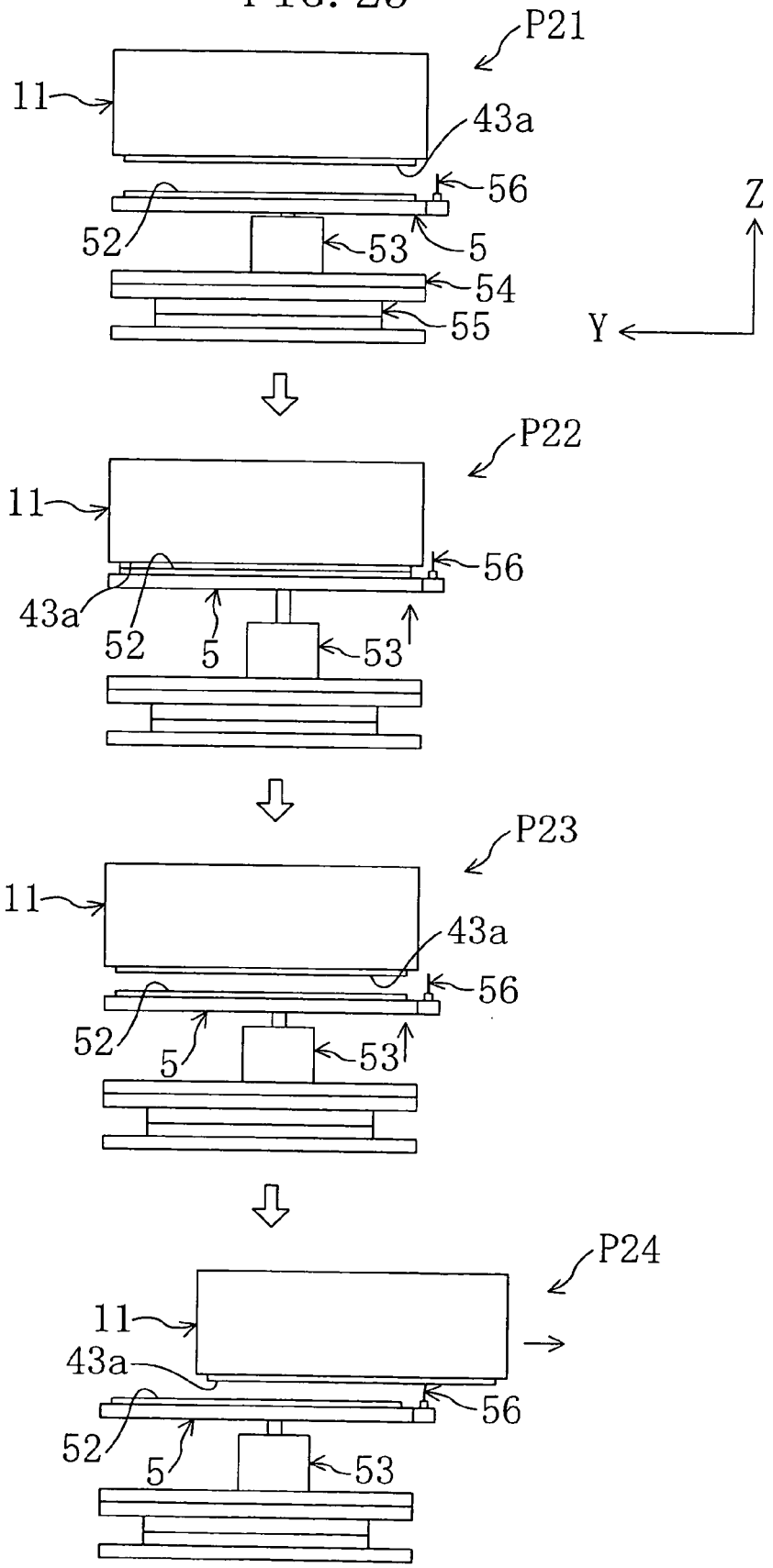
FIG. 25 illustrates the steps of an cleaning operation for a nozzle surface.

Each purge unit 5 is supported and vertically moved by a linear actuator 53 as shown in FIG. 25. With this structure, the state of the purge unit 5 alternately changes between the cleaning state where each cap 52 is in close contact with the nozzle surface 43*a* of the inkjet head 11 at the cleaning position and the retreat state where the cap 52 is physically separate from the nozzle surface 43*a*.

The linear actuator 53 is supported by a fine adjustment stage 54 and a rotation stage 55 which are vertically stacked. The fine adjustment stage 54 moves by a minuscule distance along the X-axis direction. The rotation stage 55 rotates around the Z-axis. With this structure, the purge unit 5 is movable by a minuscule distance along the X-axis direction and is rotatable around the Z-axis. As described above, the inclination of each inkjet head 11 with respect to the recording medium 12 is adjusted by the first and second rotation stages 11*a* and 11*b*. The fine adjustment stage 54 and the rotation stage 55 adjust the position and inclination of the purge unit 5 according to the adjusted inclination of the inkjet head 11. With such a structure, when the purge unit 5 is in the cleaning state, the upper opening of each cap 52 of the purge unit 5 is in close contact with the nozzle surface 43*a* of a corresponding inkjet head 11, whereby the cleaning operation is surely performed.

The purge unit 5 has a wiping member 56 for wiping the nozzle surface 43*a* in a longitudinal direction as shown in FIGS. 1 and 25. In the example described herein, the wiping member 56 is a blade made of an elastic material. The blade 56 is provided to stand upright at a longitudinal end of the frame which is closer to the recording medium 12. When the purge unit 5 is lifted (but not up to a level where the cap 52 abuts the nozzle surface 43*a*), a tip of the blade 56 abuts the nozzle surface 43*a*. The inkjet head 11 is moved relatively to the purge unit 5 while the blade 56 abuts the nozzle surface 43*a*, whereby the blade 56 wipes the nozzle surface 43*a* in a longitudinal direction to remove ink adhered on the nozzle surface 43*a*. Ink remaining around a nozzle is removed by suction while the nozzle surface 43*a* is covered with the cap 52 before the blade 56 wipes the nozzle surface 43*a*.

Since the inkjet head 11 (line head 4) has an elongated shape, a large amount of ink is recovered by wiping the nozzle surface 43*a* with the blade 56. Thus, there is a possibility that the ink recovered by the blade 56 is squeezed into the nozzles 44 by the wiping operation of the blade 56.

In view of the above possibility, the purge unit 5 has an absorber 57 for absorbing ink adhered on the nozzle surface 43*a* as shown in FIGS. 23 and 24. This absorber 57 is supported by the frame 51 and provided to surround the cap 52. In other words, a portion of the absorber 57 which corresponds to the opening of the nozzle 44 is removed, and the cap 52 is provided at the portion from which the absorber 57 has been removed. When the purge unit 5 is in the cleaning state where the cap 52 is in close contact with the nozzle surface 43*a*, the absorber 57 abuts the nozzle surface 43*a*. With such a structure, the absorber 57 absorbs ink adhered on the nozzle surface 43*a* (except for a portion covered with the cap 52) before the nozzle surface 43*a* is wiped with the blade 56.

The absorber 57 may be any material capable of absorbing ink. For example, the absorber 57 may be a porous member.

Next, the cleaning operation of the purge unit 5 for cleaning the nozzle surface 43*a* is described with reference to FIG. 25. If the inkjet head 11 is moved to the cleaning position (step P21 of FIG. 25), the purge unit 5 is then lifted up by the linear actuator 53, such that the nozzle surface 43*a* is covered with the cap 52 (step P22 of FIG. 25). Then, suction means (not shown) is activated while the nozzle surface 43*a* is covered with the cap 52. As a result, the inside of the closed cap 52 results in a negative pressure state, so that ink adhered in the vicinity of the opening of the nozzle 44 is removed.

At the above step, the absorber 57 provided around the cap 52 abuts the nozzle surface 43*a*, so that ink adhered on a portion of the nozzle surface 43*a* which is not covered with the cap 52 is absorbed by the absorber 57.

After the ink adhered on the nozzle surface 43*a* has been removed by using the cap 52, the suction means, and the absorber 57, the purge unit 5 is lowered by the linear actuator 53 by a predetermined height (step P23 of FIG. 25). With this state, the inkjet head 11 is moved to a recording position (step P24 of FIG. 25), whereby the tip of the blade 56 wipes the nozzle surface 43*a* in a longitudinal direction. Thus, cleaning of the inkjet head 11 is completed.

The purge unit 5 of the recording apparatus A is provided at an external position of the recording medium 12 in a width direction (Y direction) and extends along Y direction along with a corresponding one of the inkjet heads 11. The recording apparatus A moves each inkjet head 11 along the longitudinal direction between a recording position and a cleaning position. With this structure, the size of the recording apparatus A in the transfer direction of the recording medium 12 (X direction) is decreased.

Each of the four inkjet heads 11 can independently moved between the recording position and the cleaning position as described above. For example, it is possible that some of the four inkjet heads 11 which need cleaning are moved to the cleaning position to be cleaned whereas the other inkjet heads 11 remain at the recording position. Alternatively, it is possible that the four inkjet heads 11 are sequentially cleaned such that a first-cleaned inkjet head 11 is moved back to the recording position for test printing on the recording medium 12 while the subsequent inkjet heads 11 are being cleaned. Thus, the time required for cleaning is reduced.

The absorber 57 is provided around the cap 52 and therefore does not abut the nozzle 44 even if the purge unit 5 is in the cleaning state. If the absorber 57 should abut the nozzle 44, the absorber 57 would absorb ink inside the nozzle head. Thus, the absorption function of absorbing remaining ink adhered on the nozzle surface 43*a* can be impaired. In view of such, according to the present invention, the absorber 57 is prevented from abutting the nozzle 44, such that the absorber 57 does not absorb the ink inside the head. Thus, the absorber 57 surely absorbs the ink adhered on the nozzle surface 43*a*.

The absorbers 57 may retreat back into gaps between the nozzle plates 43 as shown in FIG. 24 when the purge unit 5 is brought into close contact with the inkjet head 11. For example, the absorber 57 may be supported by the frame 51 such that the surface of the absorber 57 is flush with, or extends ahead of, the upper end of the cap 52. With such a structure, ink remaining in the gaps between the nozzle plates 43 is efficiently absorbed by the absorber 57. As a result, contamination of the recording medium 12, etc., is surely prevented.

In FIG. 23, a plurality of caps 52 are provided to the nozzle plates 43 included in the inkjet head 11 on a one-to-one manner, but the present invention is not limited thereto. For example, one elongated cap may be provided to cover all of the nozzle plates 43. In this case, it is difficult to bring the entire circumference of the elongated cap into close contact with the nozzle surface 43*a*. Thus, it is necessary to adopt a measure for surely removing ink in order to enhance the suction capacity of the suction means.

(Other Examples of Absorber)

[First Alternative Example]

If the absorber 57 abuts the nozzle surface 43*a* such that the entire surface of the absorber 57 comes in contact with a large area of the nozzle surface 43*a* at one time, the absorber 57 cannot entirely absorb the ink remaining on the nozzle surface 43*a*, and ink left unabsorbed can be spread over the nozzle surface 43*a*. In view of such, the absorber 57 may be structured such that a surface region of the absorber 57 which abuts the nozzle surface 43*a* changes with the lapse of time. Herein, the change of the surface region includes an example where a surface region that abuts the nozzle surface 43*a* prior to the other region is detached away from the nozzle surface 43*a* when the other region comes in contact with the nozzle surface 43*a* and an example where a surface region that abuts the nozzle surface 43*a* prior to the other region is kept in contact with the nozzle surface 43*a* when the other region comes in contact with the nozzle surface 43*a*.

Specifically, a surface of the absorber 57 (a surface which abuts the nozzle surface 43*a*) may have convexities and concavities. With this structure, when the purge unit 5 is lifted up, the convexities abut the nozzle surface 43*a* prior to the concavities, and then, the concavities abut the nozzle surface 43*a*. In this example, the convexities are kept in contact with the nozzle surface 43*a* even when the concavities come in contact with the nozzle surface 43*a*. Even when the absorber 57 has an undulated surface, the above effects are achieved. Alternatively, the absorber 57 may have an arch-like surface where a longitudinal center portion is bulkier than both ends of the arch. In this case, when the purge unit 5 is lifted up, the center portion of the absorber 57 first abuts the nozzle surface 43*a*, and thereafter, the both ends abut the nozzle surface 43*a*.

[Second Alternative Example]

Figure 26:
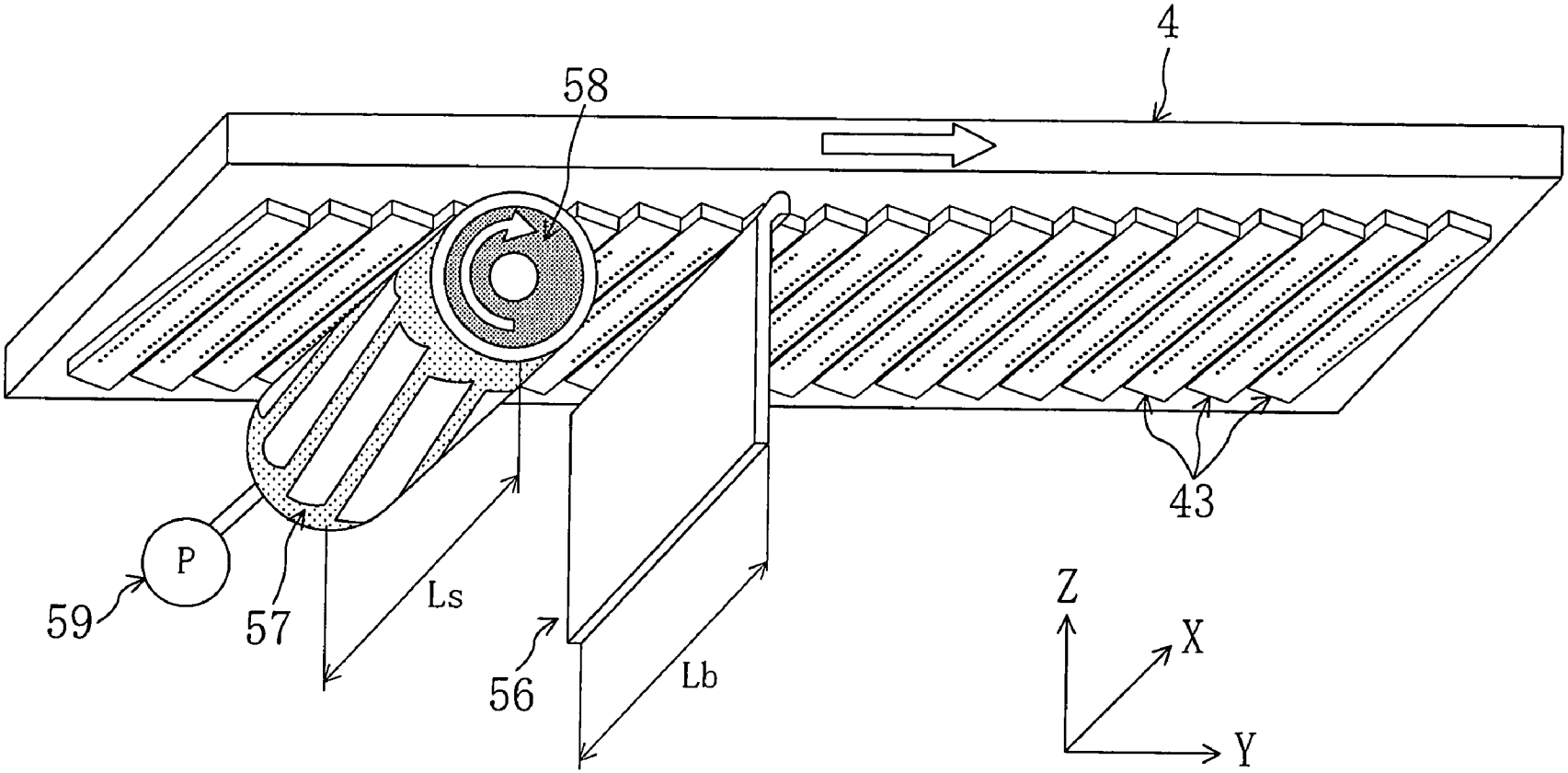
FIG. 26 is a perspective view of an embodiment employing a cylindrical absorber.

Alternatively, as shown in FIG. 26, the absorber 57 may have a cylindrical shape, which is attached around the external surface of a cylinder 58. This cylindrical absorber 57 is provided such that the cylinder shaft of the cylindrical absorber 57 extends in a direction perpendicular to the longitudinal direction of the nozzle surface 43*a*. The cylindrical absorber 57 has a height generally equal to that of the blade 56 and is provided behind the blade 56 with respect to the travel direction of the inkjet head 11 (the travel direction taken when the inkjet head 11 moves from the cleaning position to the recording position).

After suction of ink with the cap 52 and the suction means has been completed, at steps P23 and P24 of FIG. 25, the cylindrical absorber 57 is rotated around the cylinder shaft in synchronization with the travel of the inkjet head 11 while the cylindrical absorber 57 is kept in contact with the nozzle surface 43*a* (the position of the cylindrical absorber 57 is not moved). In this case, a surface region of the absorber 57 which first comes in contact with the nozzle surface 43*a* is detached from the nozzle surface 43*a* when another surface region comes in contact with the nozzle surface 43*a*. That is, the absorber 57 abuts (comes in contact with) the nozzle surface 43*a* elongated in the longitudinal direction such that the surface region of the absorber 57 which is in contact with the nozzle surface 43*a* gradually changes in a perimeter direction (i.e., along the rotation direction), thereby absorbing ink adhered on the nozzle surface 43*a*. In this structure, the nozzle surface 43*a* abuts the blade 56 after abutting the absorber 57. Thus, a series of cleaning operations are realized such that the nozzle surface is wiped with the blade 56 after ink has been absorbed by the absorber 57.

Figure 27A:
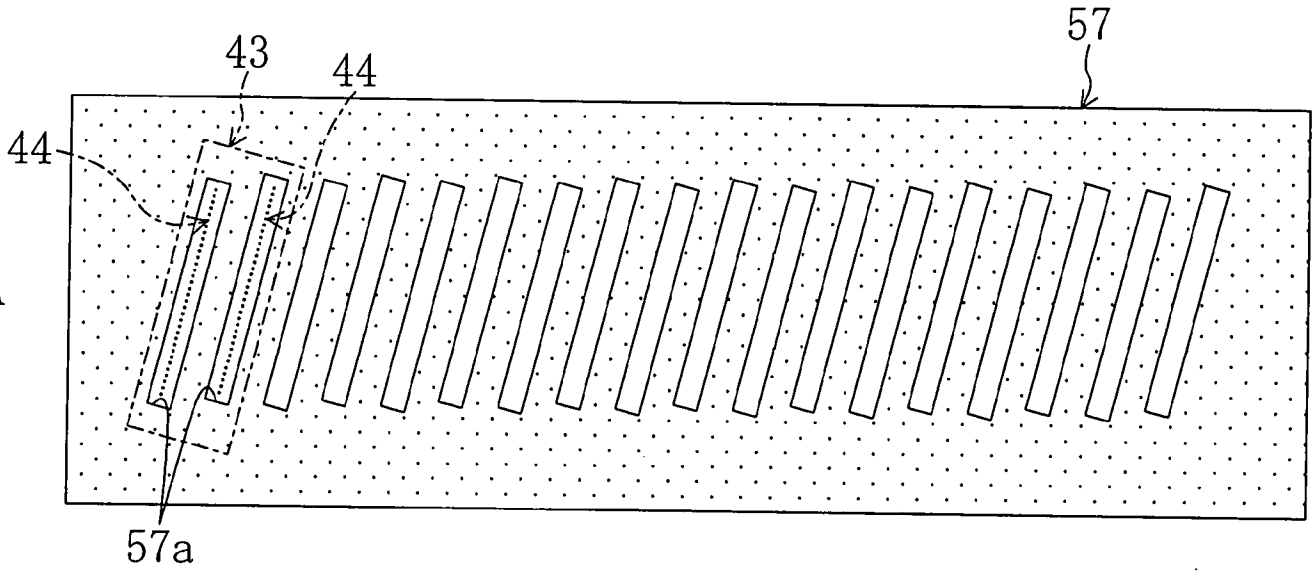
FIG. 27A is a developed view of a cylindrical absorber.
Figure 27B:
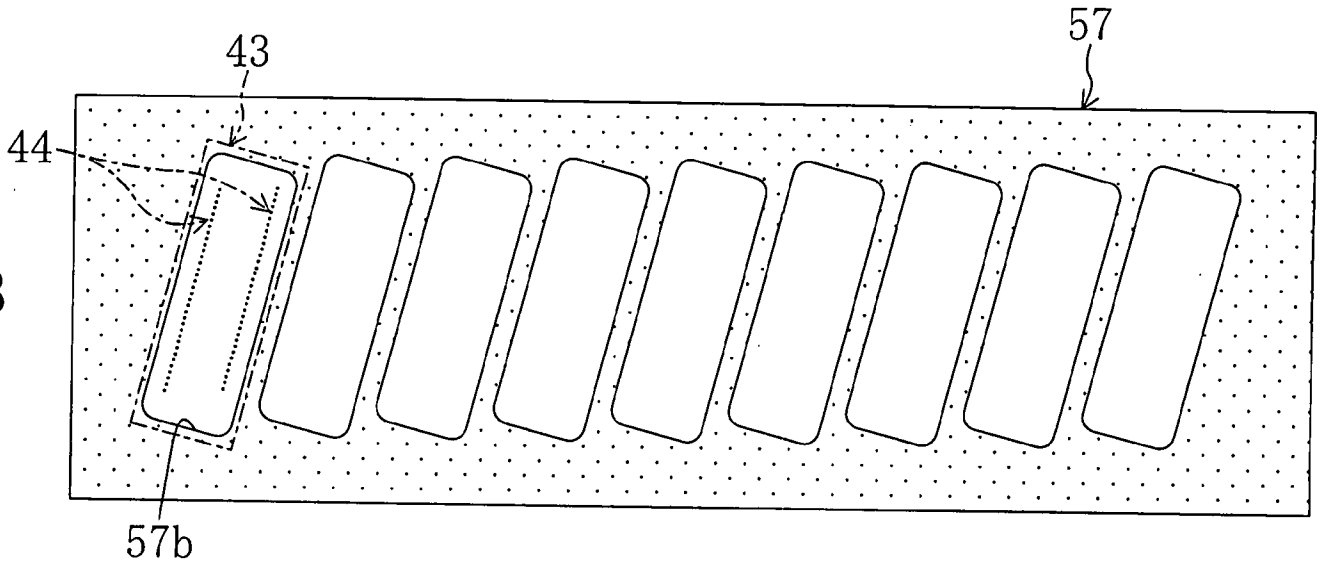
FIG. 27B is a developed view of an alternative cylindrical absorber which is different from that of FIG. 27A.

Since the absorber 57 is attached over the external surface of the cylinder 58, the absorber 57 has a belt-like shape when developed as shown in FIG. 27A. As described above, the absorber 57 preferably has openings 57*a* at the portions that can abut the nozzles 44 in order to prevent ink inside the nozzle head from being absorbed. In the example of FIG. 27A, one nozzle plate 43 has two rows of nozzles 44, and an opening 57*a* is formed for each row of nozzles 44. With this structure, ink adhered on a region between the rows of nozzles 44 is absorbed by the absorber 57. Alternatively, the absorber 57 may have openings 57*b* which correspond to respective one of the nozzle plates 43 as shown in FIG. 27B.

In the example where the absorber 57 is attached onto the external surface of the cylinder 58, the size of the absorber 57 is small as compared with the case where the absorber 57 is attached to the frame 51 (see FIG. 23). Even if a line head 4 having a different length is employed (even if the number of the head bases 41 attached to the base plate 42 is changed to construct a recording apparatus that complies with a recording medium 12 having a different width), the same absorber 57 can also be employed in this recording apparatus. Thus, the same element (absorber) can be commonly used for different types of recording apparatuses.

Alternatively, the cylinder 58 onto which the absorber 57 is attached is formed of a porous material, and a suction pump 59 may be provided in the hollow inside of the cylinder 58 at the central portion thereof. With this structure, ink absorbed by the absorber 57 is collected by the suction pump 59. The cylindrical absorber 57 has a relatively small volume as described above and therefore can be saturated with ink. With the suction pump 59 for sucking up the ink absorbed by the absorber 57, stable ink absorption is realized. It should be noted that the suction pump 59 is applicable to the example of FIG. 23 where the absorber 57 is supported by the frame 51. In this case, the suction pump 59 is connected to a portion of the absorber 57 other than the surface thereof (the surface which abuts the nozzle surface 43*a*).

The suction pump 59 may be activated during the time when the absorber 57 which is in contact with the nozzle surface 43*a* is absorbing ink. With such an operation, ink absorbed by the absorber 57 is sucked by the suction pump 59 at all times, whereby ink dripping is effectively prevented when the absorber 57 is detached from the nozzle surface 43*a*. Alternatively, the suction pump 59 may be activated during the time when the absorber 57 is away from the nozzle surface 43*a* so as not to absorb ink.

The length of the absorber 57 along the cylinder axis direction (width Ls) is preferably shorter than the length of the blade 56 (width Lb) (Ls<Lb). With such a structure, even if ink is spread in width directions over the nozzle surface 43*a* at the time when the absorber 57 comes in contact with the nozzle surface 43*a*, the ink spread in the width directions and left unabsorbed by the absorber 57 is surely wiped away by the blade 56 that is wider than the absorber 57.

[Third Alternative Example]

Although in each of the above examples the absorber 57 is provided in the purge unit 5, an absorber 9 may be provided in the line head 4 as shown in FIG. 28.

In the case where a large number of nozzle heads 6 are arranged side by side to form a line head 4 as in this embodiment, ink sometimes remains at edges of each nozzle plate 43 after the blade 56 has wiped the nozzle surface in the longitudinal direction (the remaining ink is condensed because of evaporation of moisture to have high concentration and high viscosity). There is a possibility that the remaining ink causes contamination of the recording medium 12 and that the remaining ink is squeezed into the nozzles 44 when the blade 56 wipes the nozzle surface 43*a* again.

In view of such, the absorber 9 is provided on the nozzle surface 43*a* to surround the nozzle plate 43 as shown in FIG. 28. With such a structure, ink remaining after the blade 56 has wiped the nozzle surface 43*a* is absorbed by the absorber 9. Thus, contamination of the recording medium 12 and clogging of the nozzles 44 are prevented.

Figure 28A:
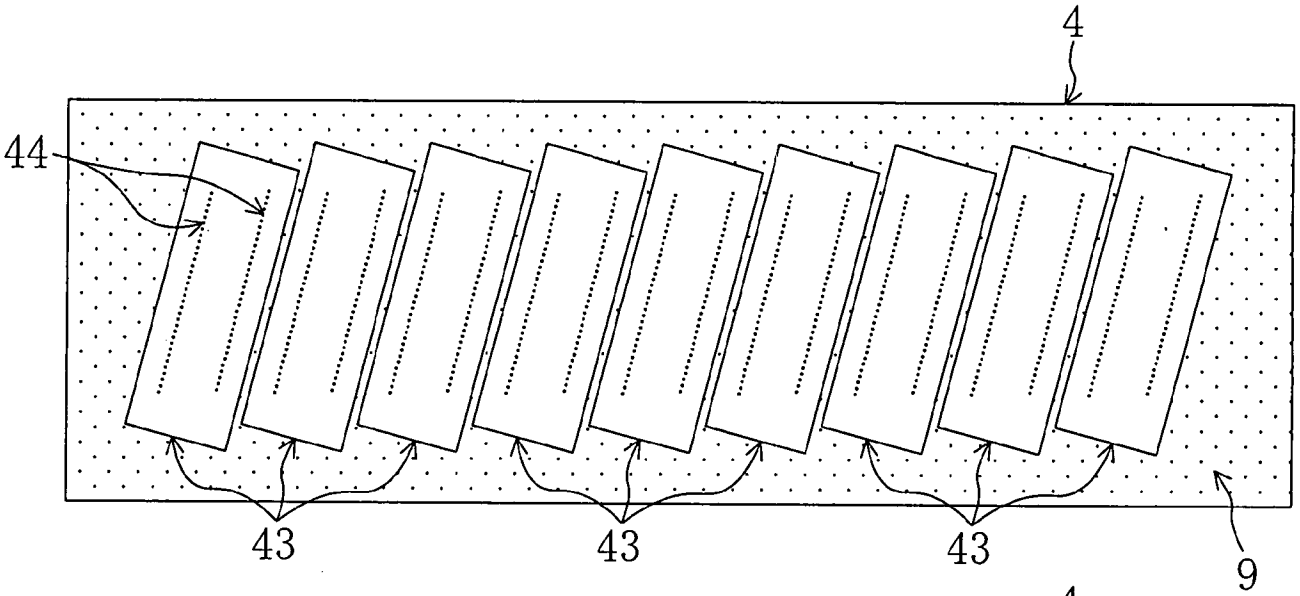
FIG. 28A is a bottom view of a line head having an absorber.
Figure 28B:
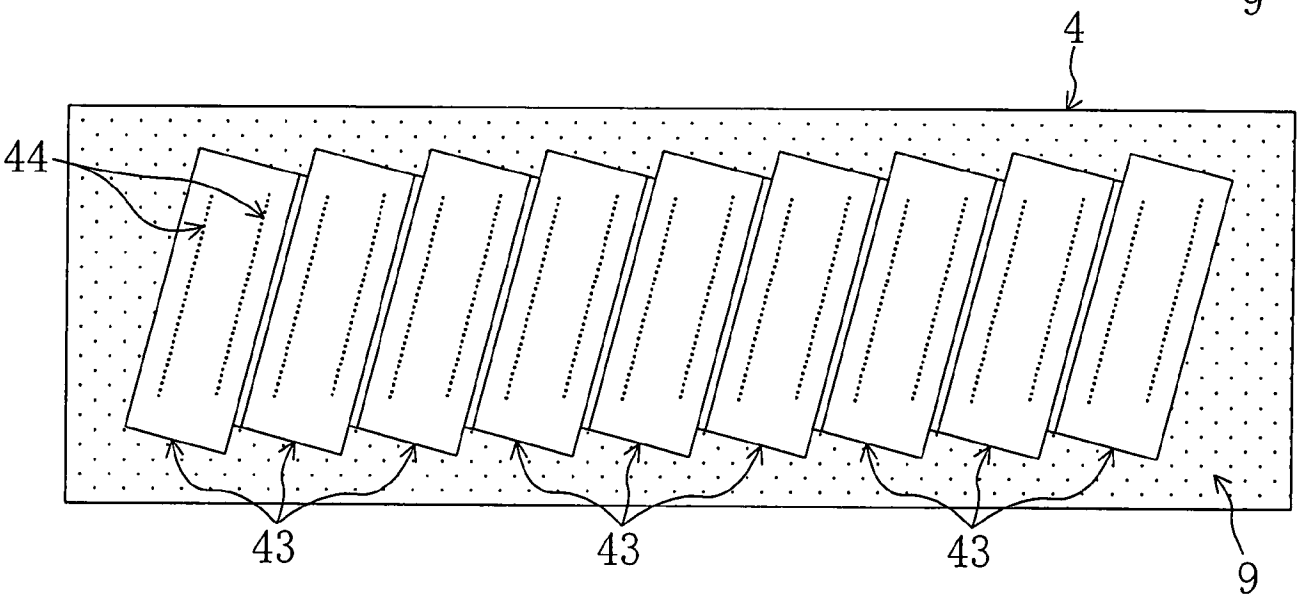
FIG. 28B is a bottom view of a line head having an alternative absorber which is different from that of FIG. 28A.

Preferably, the absorber 9 is flush with or retreats behind the surface of the nozzle plates 43. Further, the absorber 9 may be provided in the gaps between the nozzle plates 43 as shown in FIG. 28A. Alternatively, especially when the gaps between the nozzle plates 43 are very narrow, it is not necessary to provide the absorber 9 in the gaps as shown in FIG. 28B. It should be noted that, in the case where the absorber 9 is provided in the gaps between the nozzle plates 43, ink remaining at the edges of the nozzle plates 43 is efficiently absorbed.

It should be noted that absorbers may be provided in both the purge unit 5 and the line head 4 or may be provided in any one of the purge unit 5 and the line head 4.

Other Embodiments

The present invention is not limited to a nozzle head having a piezoelectric actuator. For example, the nozzle head may have a heat generation element.

The present invention is not limited to a line head having nozzles over the entire width of a recording medium.

The recording apparatus may be an apparatus having one line head and one purge unit.

The present invention is applicable not only to a recording apparatus including a line head but also to a serial recording apparatus.

The present invention is not limited to the examples described above but can be embodied in various forms without departing from the spirit and essential characteristics thereof. Every aspects of the above examples are merely exemplary and therefore do no constitute a basis of restrictive interpretation. The scope of the present invention should be limited only by the claims attached hereto but should not be limited by the specific features set fourth herein. Variations and modifications made within the scope of equivalents of the claimed invention are all within the extent of the present invention.

What is claimed is:

1. An inkjet recording apparatus for ejecting ink through nozzles onto a recording medium, comprising:

a nozzle head having a nozzle surface in which at least two nozzles are provided;

an absorber configured to abut the nozzle surface to absorb ink adhered on the nozzle surface, a portion of the absorber which corresponds to openings of the nozzles being removed such that the absorber is configured to abut the nozzle surface except for a region near the nozzles;

an actuator configured to move the absorber at least one of to the nozzle surface and from the nozzle surface; and a cap provided at the portion from which the absorber is removed, the cap coming in close contact with the nozzle surface to cover the openings of the nozzles when the absorber abuts the nozzle surface.

2. The inkjet recording apparatus of claim 1, wherein a region of the absorber configured to abut the nozzle surface changes with the lapse of time.

3. An inkjet recording apparatus for ejecting ink through nozzles onto a recording medium, comprising:

a nozzle head having a nozzle surface in which at least two nozzles are provided;

an absorber configured to abut the nozzle surface to absorb ink adhered on the nozzle surface, a portion of the absorber which corresponds to openings of the nozzles being removed such that the absorber is configured to abut the nozzle surface except for a region near the nozzles;

an actuator configured to move the absorber at least one of to the nozzle surface and from the nozzle surface; and a cap provided at the portion from which the absorber is removed, the cap coming in close contact with the nozzle surface to cover the openings of the nozzles when the absorber abuts the nozzle surface, wherein at least two said nozzle heads are arranged along the width direction of the recording medium to constitute a line head.

4. The inkjet recording apparatus of claim 3, further comprising:

at least two caps for covering the openings of the nozzles provided in the nozzle surfaces of the nozzle heads, the caps respectively corresponding to the nozzle heads of the line head.

5. The inkjet recording apparatus of claim 4, wherein the absorber is provided to surround each of the caps, and wherein, when each cap comes into close contact with the nozzle surface, the absorber is pushed into a gap between adjacent nozzle heads.

6. The inkjet recording apparatus of claim 3, further comprising:

a second absorber provided to surround the nozzle head of the line head.

7. The inkjet recording apparatus of claim 3, wherein a length of an area in which the absorber and the nozzle surface come in contact with each other along the width direction of the recording medium is shorter than the entire length of the nozzle surface of the line head.

8. The inkjet recording apparatus of claim 3, wherein the absorber is a cylindrical absorber attached over an external surface of a cylindrical member, and wherein the cylindrical absorber relatively moves over the nozzle surface in a longitudinal direction of the line head while rotating around a cylinder shaft.

9. An inkjet recording apparatus for ejecting ink through nozzles onto a recording medium, comprising:

a nozzle head having a nozzle surface in which at least two nozzles are provided;

an absorber configured to abut the nozzle surface to absorb ink adhered on the nozzle surface, a portion of the absorber which corresponds to openings of the nozzles being removed such that the absorber is configured to abut the nozzle surface except for a region near the nozzles, a suction device for sucking ink absorbed by the absorber, the suction device being connected to a region of the absorber other than a portion that is configured to abut the nozzle surface; and a cap provided at the portion from which the absorber is removed, the cap coming in close contact with the nozzle surface to cover the openings of the nozzles when the absorber abuts the nozzle surface.

10. The inkjet recording apparatus of claim 9, wherein the suction device operates when the absorber abuts the nozzle surface.

11. An inkjet recording apparatus for ejecting ink through nozzles onto a recording medium, comprising:

a nozzle head having a nozzle surface in which at least two nozzles are provided;

a blade for wiping the nozzle surface, and an absorber configured to abut the nozzle surface to absorb ink adhered on the nozzle surface, the absorber being configured to abut the nozzle surface to absorb the ink before a wiping operation of the blade, wherein a width of the absorber is smaller than a width of the blade.

12. An inkjet recording apparatus for ejecting ink through nozzles onto a recording medium, comprising:

a nozzle head having a nozzle surface in which at least two nozzles are provided;

an absorber configured to abut the nozzle surface to absorb ink adhered on the nozzle surface, a portion of the absorber which corresponds to the nozzles being removed; and a cap provided at the portion from which the absorber is removed, the cap coming in close contact with the nozzle surface to cover openings of the nozzles when the absorber abuts the nozzle surface, wherein the absorber is configured to be controllably movable at least one of to the nozzle surface and from the nozzle surface.

13. The inkjet recording apparatus of claim 12, further comprising:

an actuator configured to move the absorber at least one of to the nozzle surface and from the nozzle surface.

14. An inkjet recording apparatus for ejecting ink through nozzles onto a recording medium, comprising:

a nozzle head having a nozzle surface in which at least two nozzles are provided; a wiper for wiping the nozzle surface;

an absorber configured to abut the nozzle surface to absorb ink adhered on the nozzle surface, the absorber being configured to abut the nozzle surface to absorb the ink before a wiping operation of the wiper; and a cap provided at a portion of the absorber from which the absorber is removed, the cap coming in close contact with the nozzle surface to cover openings of the nozzles when the absorber abuts the nozzle surface.

* * * * *